US012630952B2

(12) United States Patent
Feng et al.

(10) Patent No.: US 12,630,952 B2
(45) Date of Patent: May 19, 2026

(54) NEEDLE BED AND NEEDLE COMBINATION FOR FLAT KNITTING MACHINE AND NEEDLE SELECTION MECHANISM

(71) Applicants: Jialin Feng, Nanjing (CN); Tianyuan Feng, Nanjing (CN); Youqun Wu, Nanjing (CN)

(72) Inventors: Jialin Feng, Nanjing (CN); Tianyuan Feng, Nanjing (CN); Youqun Wu, Nanjing (CN)

( * ) Notice: Subject to any disclaimer, the term of this patent is extended or adjusted under 35 U.S.C. 154(b) by 0 days.

(21) Appl. No.: 17/920,417

(22) PCT Filed: Mar. 16, 2021

(86) PCT No.: PCT/CN2021/080910

§ 371 (c)(1),
(2) Date: Oct. 21, 2022

(87) PCT Pub. No.: WO2021/213077

PCT Pub. Date: Oct. 28, 2021

(65) Prior Publication Data

US 2023/0146969 A1 May 11, 2023

(30) Foreign Application Priority Data

Apr. 21, 2020 (CN) ..... 202010316107.2

(51) Int. Cl.
*D04B 15/70* (2006.01)
*D04B 7/04* (2006.01)
(Continued)

(52) U.S. Cl.
CPC ..... *D04B 15/70* (2013.01); *D04B 7/04* (2013.01); *D04B 15/06* (2013.01); *D04B 15/10* (2013.01);
(Continued)

(58) Field of Classification Search
CPC ..... D04B 7/04; D04B 15/70; D04B 15/06; D04B 15/10; D04B 15/28; D04B 15/36; D04B 15/362; D04B 15/00
See application file for complete search history.

(56) References Cited

U.S. PATENT DOCUMENTS 3,115,760 A * 12/1963 Pierce ..... D04B 15/70 66/65
3,892,108 A 7/1975 Hadam
(Continued)

FOREIGN PATENT DOCUMENTS

CN 101570914 A 11/2009
CN 202369758 U 8/2012
(Continued)

OTHER PUBLICATIONS

Guangli Song, et al., Practical Handbook of Computerized Flat Knitting Machine, China Textile Press, 2010, pp. 73-74.
(Continued)

*Primary Examiner* — Aiying Zhao
(74) *Attorney, Agent, or Firm* — Bayramoglu Law Offices LLC

(57) ABSTRACT

A needle bed and needle combination for a flat knitting machine includes a needle bed, a plurality of parallel sinkers provided at a front end of the needle bed, knitting needles and stitch elements provided in needle grooves, and a needle selection unit. Two knitting needles are arranged in parallel in the needle groove between every two adjacent sinkers, and are separately configured to make a knit stitch, a tuck stitch and a loop transfer stitch. The stitch element includes a control stitch element and elastic stitch elements. The control stitch element, the elastic stitch elements and the needle selection unit form the needle selection mechanism. Two elastic stitch elements are connected to the two knitting needles, respectively. The control stitch element is located
(Continued)

above and engaged with the two elastic stitch elements. The needle selection unit is provided above the two elastic stitch elements.

22 Claims, 15 Drawing Sheets

(51) Int. Cl.
*D04B 15/06* (2006.01)
*D04B 15/10* (2006.01)
*D04B 15/28* (2006.01)
*D04B 15/36* (2006.01)

(52) U.S. Cl.
CPC ..... *D04B 15/28* (2013.01); *D04B 15/36* (2013.01); *D04B 15/362* (2013.01)

(56) References Cited

U.S. PATENT DOCUMENTS 4,510,775 A 4/1985 Shima
4,637,227 A * 1/1987 Shima ..... D04B 15/365 66/120
4,905,483 A * 3/1990 Shima ..... D04B 7/32 66/69
5,636,532 A * 6/1997 Shima ..... D04B 1/102 66/60 R
5,694,792 A * 12/1997 Nakamori ..... D04B 15/78 66/75.1
2019/0003088 A1* 1/2019 Wörnle ..... D04B 35/02
2019/0191821 A1* 6/2019 Hymas ..... D04B 1/102

FOREIGN PATENT DOCUMENTS

EP 0672770 A1 9/1995
EP 0748887 A1 12/1996
JP H07258945 A 10/1995
JP 07324260 A * 12/1995
JP 08113853 A * 5/1996
JP H08113853 A 5/1996
JP 2724676 B2 3/1998
JP 2006183190 A * 7/2006
KR 19960013902 B1 10/1996
KR 20180033284 A 4/2018

OTHER PUBLICATIONS

Guangli Song et al., Practical Handbook of Computerized Flat Knitting Machine, China Textile Press, 2010, pp. 71-72.

* cited by examiner

NEEDLE BED AND NEEDLE COMBINATION FOR FLAT KNITTING MACHINE AND NEEDLE SELECTION MECHANISM

CROSS REFERENCE TO THE RELATED APPLICATIONS

This application is the national phase entry of International Application No. PCT/CN2021/080910, filed on Mar. 16, 2021, which is based upon and claims priority to Chinese Patent Application No. 202010316107.2, filed on Apr. 21, 2020, the entire contents of which are incorporated herein by reference.

TECHNICAL FIELD

The present disclosure relates to the field of flat knitting machines, and in particular to a needle bed and needle combination for a flat knitting machine, and a choosing one from two needle selection mechanism.

BACKGROUND

In the traditional manufacturing process, the front piece, back piece, sleeves, and collar of a sweater are knitted by a flat knitting machine and linked together by a garment worker using a special dial linking machine. The traditional manufacturing process is complex, labor-intensive, inefficient, and costly. In order to overcome these problems, some sweater manufacturers use an ordinary flat knitting machine with double needle beds to carry out knitting complete garment at once by using every other needle, that is, the overcoat, sleeves, and collar are knitted at one time, also known as three-dimensional knitting. This approach has high efficiency and low production cost. However, the distance between every other needles does not achieve the standard gauge of the ordinary flat knitting machine, and the distance is greatly increased, which results in a long sinker loop between the needle loops, leading to low stitch density, and requires knitting yarn with high elasticity and strength. Since the normal gauge is not achieved, the knitted sweater has an inferior overall texture. In the prior art, there is also a four-bed flat knitting machine. Two needle beds are added above the two original ones to form the flat knitting machine with four needle beds. The knitting needles in such knitting machine are arranged up and down, but due to the structural reason, the upper knitting needles cannot be as close as the lower knitting needles to the strip-shaped opening formed by the needle bed and the sinkers during knitting, which makes it difficult for the upper knitting needles to make a knit stitch. This results in high requirements on the strength and elasticity of the wool yarn, complex on-machine process, complex structure, difficulty in making special knitting needles, and high production cost.

SUMMARY

An objective of the present disclosure is to provide a needle bed and needle combination and a needle selection mechanism for a flat knitting machine with double needle beds for normal-gauge three-dimensional knitting. The present disclosure adopts the following technical solutions:

A needle bed and needle combination is provided on each of the front and back sides of a frame of a flat knitting machine, and includes: a needle bed provided with a plurality of needle grooves, a plurality of parallel sinkers provided at a front end of the needle bed, and knitting needles and stitch elements provided in the needle grooves. A strip-shaped opening is formed by the sinkers and the front end of the needle bed for forming a knitted fabric. Two knitting needles are arranged on the left and right in the needle groove between every two adjacent sinkers, and are separately configured to make a knit stitch, a tuck stitch and a loop transfer stitch. The two knitting needles are arranged in parallel or are arranged at an angle with each other in a length direction in respective needle grooves, and a front end of each of the two knitting needles is positioned in close proximity to the strip-shaped opening.

As for the two parallel knitting needles, there are two arrangement modes relating to the needle groove and the stitch element. In a first arrangement mode, one needle groove is provided between every two adjacent sinkers on the needle bed, and two knitting needles are provided in parallel in the needle groove. The needle bed and needle combination further includes a needle selection unit. The stitch element includes elastic stitch elements and a jack. Two elastic stitch elements are connected to the two knitting needles, respectively. The jack is located above and engaged with the two elastic stitch elements. The needle selection unit is provided above the two elastic stitch elements, and is configured to operate on the elastic stitch elements. When being operated on, the elastic stitch element is deformed elastically to disengage from the jack, so as to idle the knitting needle connected to the elastic stitch element. In a second arrangement mode, two needle grooves are provided between every two adjacent sinkers on the needle bed. Each of the two knitting needles is provided in a corresponding needle groove, and a jack is provided on each knitting needle.

When the two knitting needles are arranged at an angle with each other in a length direction in respective needle grooves, a jack is provided on each knitting needle.

The needle selection unit includes a control element provided on a cam plate, a first pressing piece provided with a first pressing portion and a first control portion, and a second pressing piece provided with a second pressing portion and a second control portion. The first pressing portion and the second pressing portion are located above the corresponding elastic stitch elements, respectively. The first control portion and the second control portion are respectively located at different positions in a length direction of the needle groove. The control element operates on the first control portion or the second control portion to move the first pressing piece or the second pressing piece. The first pressing portion or the second pressing portion then presses the corresponding elastic stitch element, such that the pressed elastic stitch element is deformed elastically to disengage from the jack, so as to idle the corresponding knitting needle connected to the elastic stitch element.

In a further design of the aforementioned needle selection unit, the first pressing piece and the second pressing piece are movable up and down, and are arranged side by side in the needle groove. Each of the first pressing piece and the second pressing piece includes a main body and a protrusion. The protrusion of the first pressing piece and the protrusion of the second pressing piece are provided at upper side ends of corresponding main bodies respectively to form a first control portion of the first pressing piece and a second control portion of the second pressing piece. The lower sides of the main bodies of the two pressing pieces are provided with the first pressing portion and the second pressing portion, respectively. The control elements may be two pressing plates provided on a cam plate of the flat knitting machine, and located above the protrusion of the first pressing piece and the protrusion of the second pressing piece, respectively. Each of the two pressing plates is provided with an inclined surface. When moving with the cam plate, the corresponding pressing plate operates on the protrusion of the corresponding pressing piece through the inclined surface, such that the corresponding pressing piece moves downward to press the corresponding elastic stitch element. After the operation of the control element on the pressing piece is removed, a returning force of elastic deformation of the elastic stitch element makes the corresponding pressing piece return to an original position. Alternatively, the first pressing piece and the second pressing piece are provided coaxially rotatable in the needle groove. Each of the first pressing piece and the second pressing piece includes a main body and a protrusion. The protrusion of the first pressing piece and the protrusion of the second pressing piece are located at staggered positions with different distances from a rotation center respectively to form a first control portion of the first pressing piece and a second control portion of the second pressing piece. The lower sides of the main bodies of the two pressing pieces are provided with the first pressing portion and the second pressing portion, respectively. The control element is provided on a cam plate of the flat knitting machine. When the control element operates on the first control portion or the second control portion, the first pressing piece or the second pressing piece is rotated downward to press the corresponding elastic stitch element. After the operation of the control element on the pressing piece is removed, a returning force of elastic deformation of the elastic stitch element makes the corresponding pressing piece return to an original position.

When the two pressing pieces are movable up and down in the needle groove, there may be at least two arrangement modes.

In a first arrangement mode, the first pressing piece and the second pressing piece have a same structure and shape in the main body and the protrusion, respectively. The first pressing piece and the second pressing piece are arranged side by side in the needle groove, with respective main bodies overlapped with each other, and are located above the corresponding elastic stitch elements, respectively. The protrusion of the first pressing piece and the protrusion of the second pressing piece are located at an upper left end of the first pressing piece and an upper right end of the second pressing piece, respectively, and staggered from each other in a direction of the needle groove. The main body is provided with two vertical guide surfaces at left and right sides and a vertical guide groove at a lower central position. The guide groove divides the first pressing portion and the second pressing portion at a lower side of the first pressing piece or the second pressing piece into two parts. The needle bed is provided with guide steel wires at positions corresponding to the two guide surfaces and the guide groove, respectively. The first pressing piece or the second pressing piece is movable up and down along the guide steel wires.

In a second arrangement mode, the first pressing piece and the second pressing piece have a same structure and shape in the main body and the protrusion. The first pressing piece and the second pressing piece touch each other on the left and right, are arranged side by side in the needle groove, and are located above the corresponding elastic stitch elements, respectively. The protrusion of the first pressing piece and the protrusion of the second pressing piece are located at an upper left end of the first pressing piece and an upper right end of the second pressing piece, respectively, and staggered from each other in a direction of the needle groove. Both of the main body and the protrusion have a thickness adapted to a width of the needle groove. A lower side of the main body is provided with a recess structure to form a lower side edge that is not greater than half the width of the needle groove. The main body is provided with a guide surface and a sliding surface at left and right sides, respectively. The needle bed is provided with guide steel wires corresponding to a side of the guide surface. The first pressing piece is movable up and down along the guide steel wires corresponding to a side of the guide surface of the first pressing piece and the sliding surface of the second pressing piece. The second pressing piece is movable up and down along the guide steel wires corresponding to a side of the guide surface of the second pressing piece and the sliding surface of the first pressing piece.

When the two pressing pieces are rotatable in the needle groove, there may be at least two arrangement modes.

In a first arrangement mode, the first pressing piece and the second pressing piece have a same structure and shape in the main body and the protrusion, respectively. The protrusion of the first pressing piece and the protrusion of the second pressing piece are located on an upper side of the main body of the first pressing piece and an upper side of the main body of the second pressing piece, respectively, and are staggered from each other. The main body of the first pressing piece and the main body of the second pressing piece are respectively provided with rotating holes at identical positions on the same side. The needle bed is provided with a rotating steel wire corresponding to the rotating holes, and provided with a limiting steel wire located above upper sides of the first pressing piece and the second pressing piece. The first pressing piece and the second pressing piece are provided in the needle groove and rotatable by the rotating steel wire passing through the rotating holes. The limiting steel wire limits movement of the pressing pieces caused by a returning force. The control elements may be two pressing plates provided on a cam plate of the flat knitting machine at positions corresponding to the protrusion of the first pressing piece and the protrusion of the second pressing piece, respectively. Each of the two pressing plates is provided with an inclined surface. When moving with the cam plate, the corresponding pressing plate presses the protrusion of the corresponding pressing piece downward through the inclined surface, such that the first pressing piece or the second pressing piece is rotated downward around the rotating steel wire.

In a second arrangement mode, the needle selection unit further includes a push piece. The push piece is provided with a needle butt and a push pin at upper and lower sides, respectively. The first pressing piece and the second pressing piece have a same structure and shape in the main body. The protrusion includes a first protrusion and a second protrusion. The first protrusion is provided with a climbing surface, a descending surface, and an upper end surface connecting upper ends of the climbing surface and the descending surface. The second protrusion is provided with at least a climbing surface and an upper end surface connected to an upper end of the climbing surface. The first protrusion and the second protrusion are provided on an upper side of the main body of the first pressing piece and an upper side of the main body of the second pressing piece, respectively. Furthermore, a distance between the first protrusion and the rotation center is smaller than a distance between the second protrusion and the rotation center. The main body of the first pressing piece and the main body of the second pressing piece are respectively provided with rotating holes at identical positions on the same side. The needle bed is provided with a rotating steel wire at a position corresponding to the rotating holes, and provided with a stopper and guide steel wires at positions corresponding to the upper and lower sides of the push piece, respectively. The first pressing piece and the second pressing piece are provided in the needle groove and rotatable by the rotating steel wire passing through the rotating holes. The push piece is located above the first pressing piece and the second pressing piece, and is slidable between the stopper and the guide steel wires. The control element is a push plate provided on a cam plate of the flat knitting machine, and movable in a direction of the needle groove. The push plate is provided with a guide groove adapted to the needle butt. When the corresponding push plate moves with the cam plate, the needle butt of the push piece is inserted into the push plate through the guide groove. Through the movement of the control element in the direction of the needle groove, the push pin operates on the climbing surface of the first protrusion or the second protrusion, so as to rotate the corresponding pressing piece downward.

In a further design of the aforementioned needle selection unit, a lower side of the elastic stitch element is provided with a limiting protrusion, and a bottom of the needle groove is provided with a limiting groove. When the elastic stitch element falls into the limiting groove due to elastic deformation, the limiting groove limits front-back movement of the elastic stitch element. Moreover, a support rod is provided in the needle groove, and the jack is supported by the support rod to be located above the two elastic stitch elements.

The present disclosure has the following advantages. 1) Two knitting needles are arranged between every two sinkers, increasing the number of knitting needles without increasing the number of sinkers. The number of the knitting needles arranged on the needle bed with the same spacing between the sinkers is doubled, maximizing usage of the lateral space of the needle bed. In this way, the flat knitting machine with double needle beds can produce three-dimensional knitted fabric with a standard gauge. 2) The two knitting needles arranged on the left and right between every two adjacent sinkers are positioned in close proximity to the strip-shaped opening, so the two knitting needles which knit separately have the same knitting effect. Therefore, the present disclosure provides a simple on-machine process, is easy to operate and easy to be accepted by the user, has no special requirements on knitting yarn, and is useable in many knitting applications. 3) The present disclosure features a knitting machine with simple structure that affords an easy production process, convenient maintenance, and low production cost.

Figure 1:
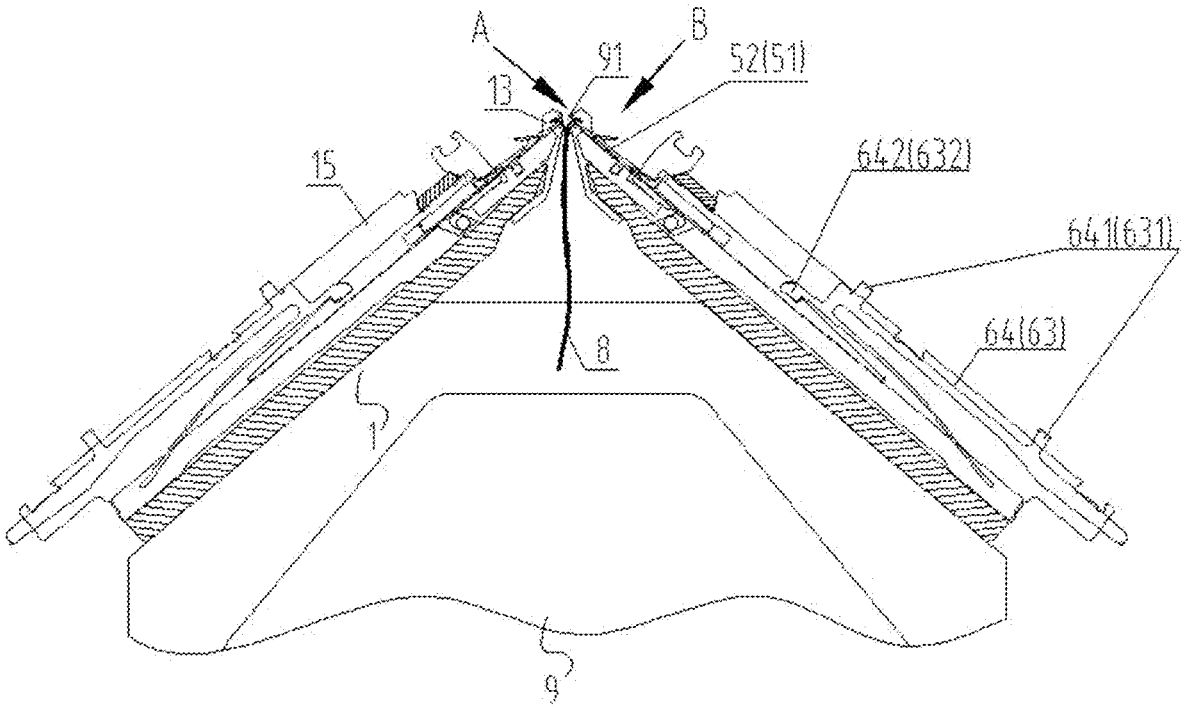
FIG. 1 is a structural view of a needle bed and needle combination provided on a flat knitting machine according to Embodiment 1 of the present disclosure.

Reference Numerals: 1. needle bed; 11, 111, 112. needle groove; 12. support rod; 13. sinker; 14. separating piece; 15. steel piece; 161. support steel wire; 162. guide steel wire; 163. limiting steel wire; 164. rotating steel wire; 17. stopper; 18. limiting groove; 3*a*, 3*b*, 3*c*, 3*d*. needle selection unit; 3*a*1, 3*b*1, 3*c*1, 3*d*1. first pressing piece; 3*a*2, 3*b*2, 3*c*2, 3*d*2. second pressing piece; 3*d*3. push piece; 3*aa*, 3*ba*, 3*ca*, 3*da*. main body of pressing piece; 3*ab*, 3*bb*, 3*cb*, 3*db*. protrusion of pressing piece; 3*ac*, 3*bc*, 3*cc*, 3*dc*. pressing portion of pressing piece; 3*aa*1, 3*ba*2, 3*ba*3. guide surface of main body; 3*aa*2. guide groove of main body; 3*ba*1. sliding surface of main body; 30. control element; 301, 302. pressing plate; 3021. inclined surface; 31. push plate; 311. guide groove; 51, 52. knitting needle; 60, 63, 64, 65, 66. jack; 601, 631, 641, 651, 661. stitch butt; 602, 632, 642, 652, 662. connecting head; 61, 62. elastic stitch element; 611, 621. limiting protrusion; 8. knitted fabric; 9. frame; and 91. strip-shaped opening.

DETAILED DESCRIPTION OF THE EMBODIMENTS

The present disclosure is described in detail below with reference to the drawings.

Embodiment 1

Figure 2:
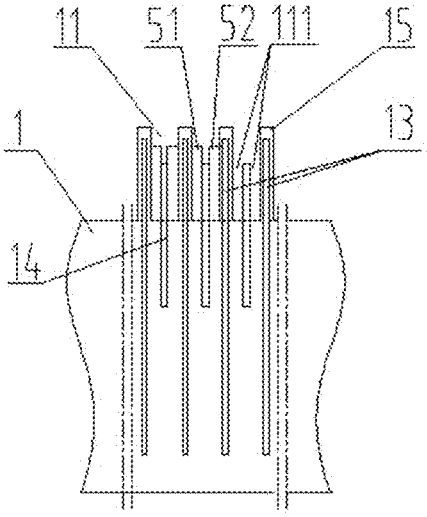
FIG. 2 is an A-direction view of the needle bed and needle combination shown in FIG. 1.
Figure 3:
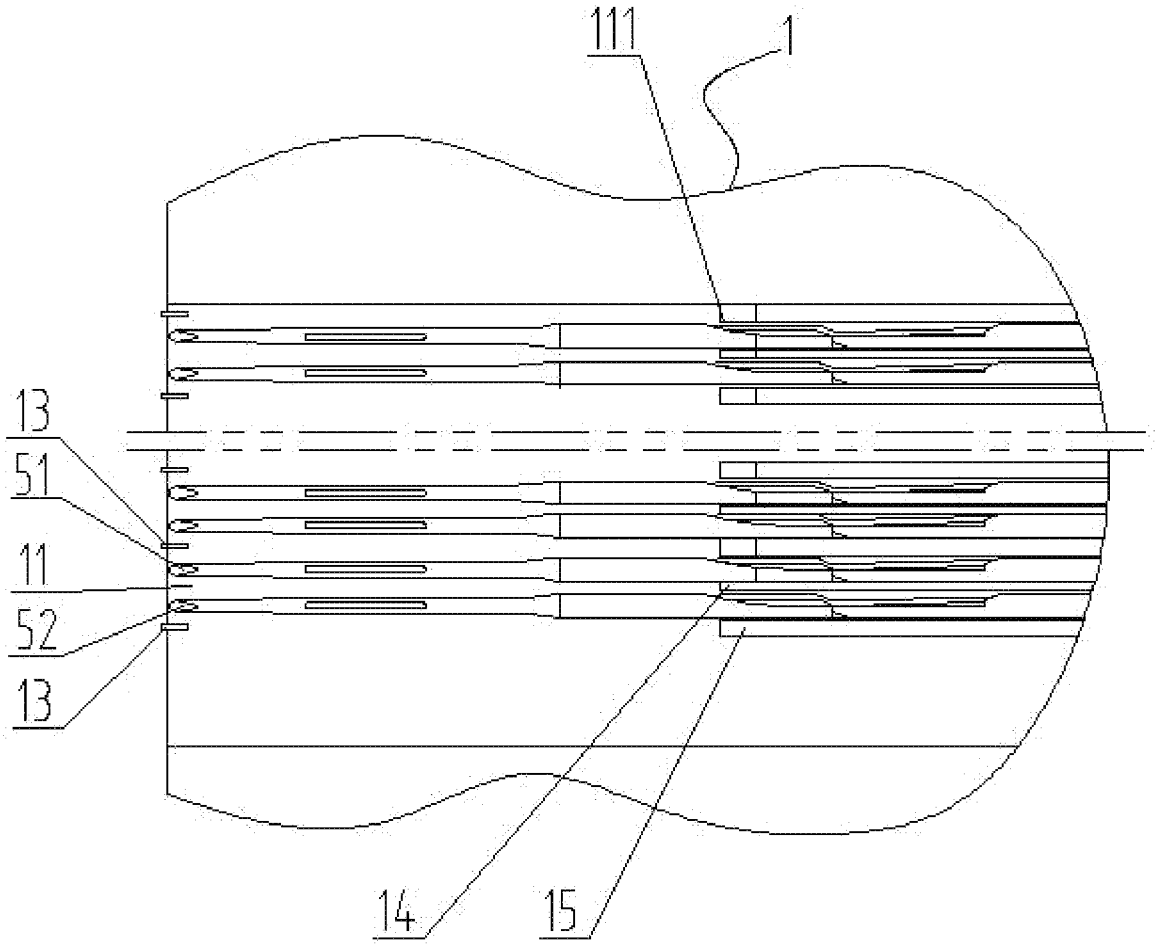
FIG. 3 is a B-direction view of the needle bed and needle combination shown in FIG. 1.
Figure 4:
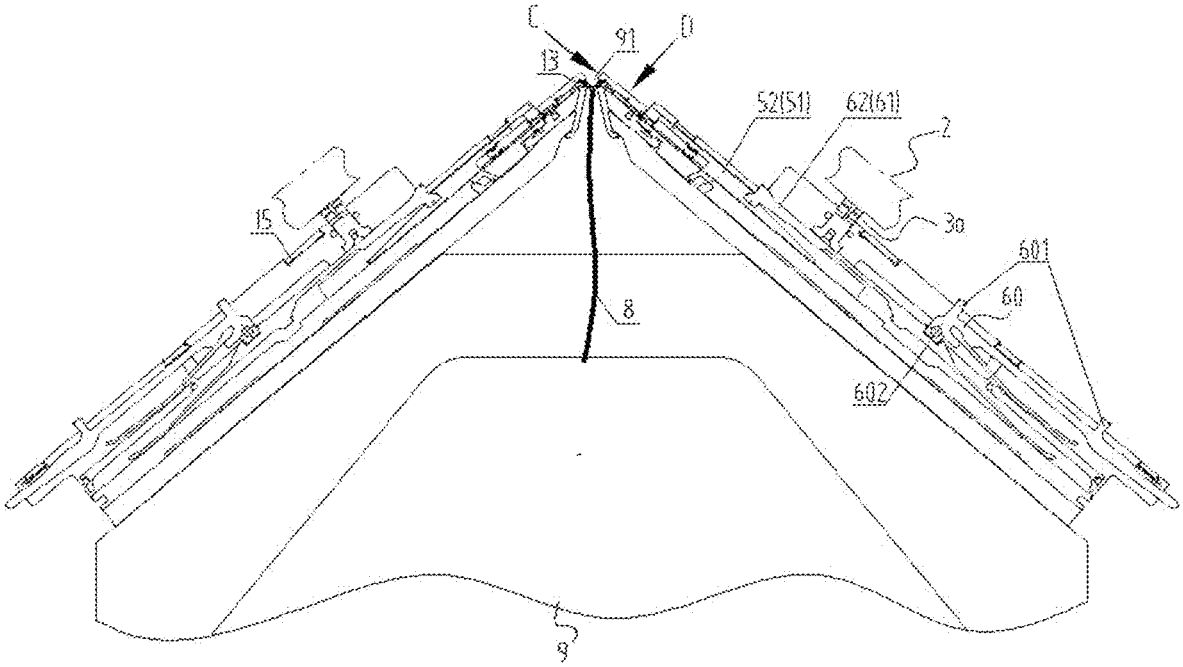
FIG. 4 is a structural view of a needle bed and needle combination provided on a flat knitting machine according to Embodiment 2 of the present disclosure.
Figure 5:
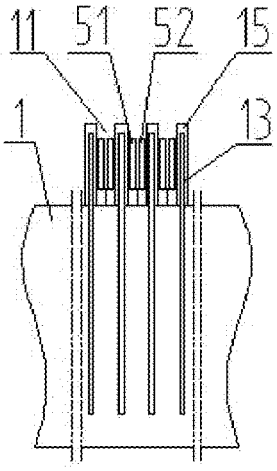
FIG. 5 is a C-direction view of the needle bed and needle combination shown in FIG. 4 (as well as FIGS. 18, 29, and 42).
Figure 6:
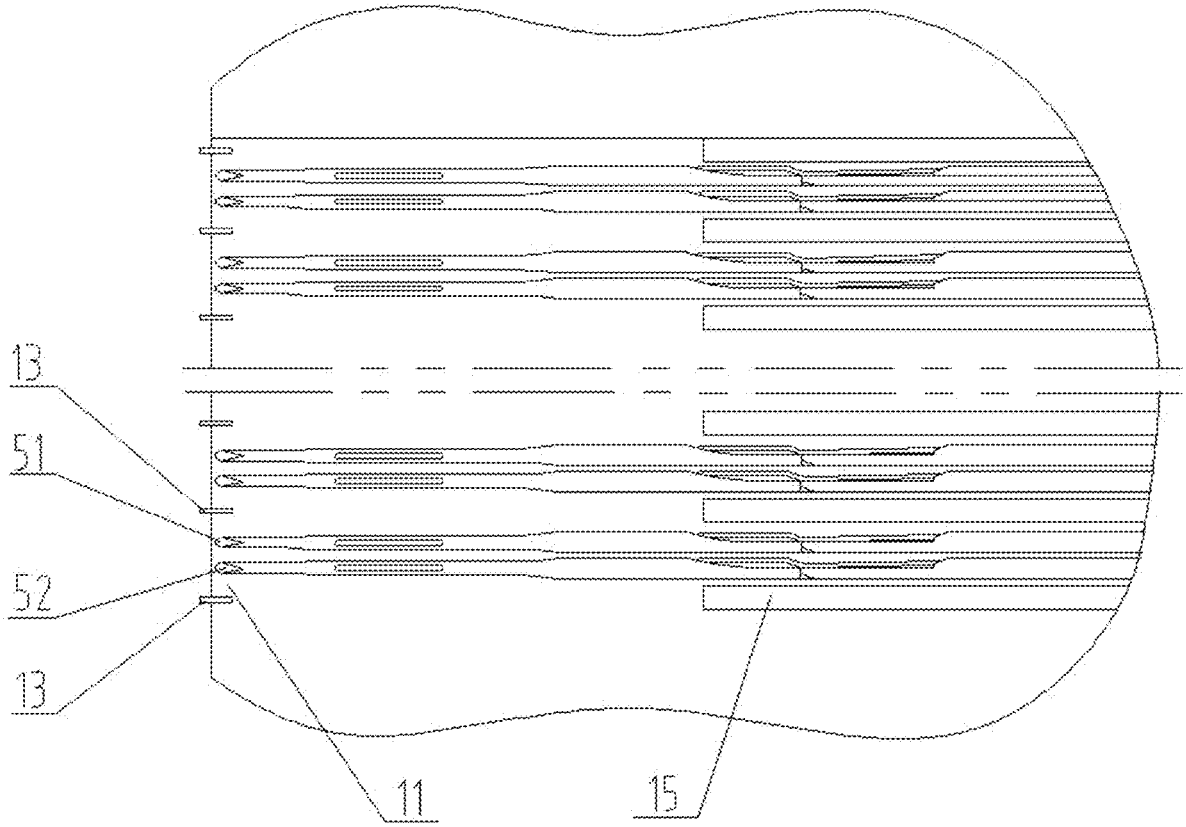
FIG. 6 is a D-direction view of the needle bed and needle combination shown in FIG. 4 (as well as FIGS. 18, 29, and 42).

As shown in FIGS. 1, 2, and 3, this embodiment provides a needle bed and needle combination. The needle bed and needle combination includes a needle bed provided with a plurality of needle grooves 11, a plurality of parallel sinkers 13 provided at a front end of the needle bed, and knitting needles 51, 52 and stitch elements provided in the needle grooves. The needle bed and needle combinations are provided on each of the front and back sides of a frame 9 of a flat knitting machine through the needle bed 1. The biggest difference between the needle bed and needle combinations of the present disclosure and the prior art is that in the present disclosure, the two knitting needles 51, 52 are arranged on the left and right between every two sinkers on the needle bed 1, and the two knitting needles are separately configured to make knitting actions including a knit stitch, a tuck stitch and a loop transfer stitch.

In this embodiment, two parallel needle grooves 111 are arranged between every two sinkers on the needle bed. Specifically, the needle groove 11 formed through division by two steel pieces 15 is further divided by a separating piece 14 to form two parallel needle grooves 111 between every two sinkers. Each of the two knitting needles 51, 52 is provided in one of the corresponding needle grooves 111, respectively. The knitting needles 51, 52 are driven by the corresponding jacks 63, 64 to move in the needle grooves 111, respectively, and the jacks 63, 64 are driven by a corresponding cam on a cam plate. The jack 63 comprises stitch butts 631 and a connecting head 632. The jack 64 comprises stitch butts 641 and a connecting head 642. The stitch elements are the jacks directly connected to the knitting needles as in this embodiment, and may also be composite stitch elements formed by combining two or more stitch elements.

The knitting needles provided in the needle grooves are provided in parallel, with respective front ends positioned in close proximity to a strip-shaped opening (tooth-shaped opening) 91 formed by the sinkers 13 and the front end of the needle bed 1 for forming a knitted fabric 8 (Since the sinker is called tooth-shaped bit, the strip-shaped opening is also called tooth-shaped opening).

Embodiment 2

As shown in FIGS. 4 to 7, as in Embodiment 1, the needle bed and needle combination includes a needle bed 1 provided with a plurality of parallel needle grooves 11 formed through division by steel pieces 15, a plurality of parallel sinkers 13 provided at a front end of the needle bed, and knitting needles 51, 52 provided in the needle grooves. The needle bed and needle combinations are provided on each of the front and back sides of a frame 9 of a flat knitting machine through the needle bed 1. Similarly, the two knitting needles 51, 52 are arranged in parallel on the left and right in the needle groove between every two sinkers, and the two knitting needles are separately configured to make knitting actions including a knit stitch, a tuck stitch and a loop transfer stitch.

However, in this embodiment, one needle groove 11 is provided between every two sinkers on the needle bed, and two knitting needles are provided in parallel in the same needle groove 11. When the two knitting needles perform their separate knitting actions, a needle selection unit 3*a* cooperates with a composite stitch element that includes elastic stitch elements 61, 62 and a jack 60 to select one of the knitting needles to work (i.e., to be ejected) while the other is idled. The jack 60 comprises stitch butts 601 and a connecting head 602. In this way, the two parallel knitting needles in the same needle groove can separately make knitting actions including a knit stitch, a tuck stitch and a loop transfer stitch. Therefore, in this embodiment, the needle bed and needle combination is further provided with a needle selection mechanism, where the needle selection mechanism includes at least the needle selection unit 3*a* and the composite stitch element that includes the elastic stitch elements and the jack.

Figure 7:
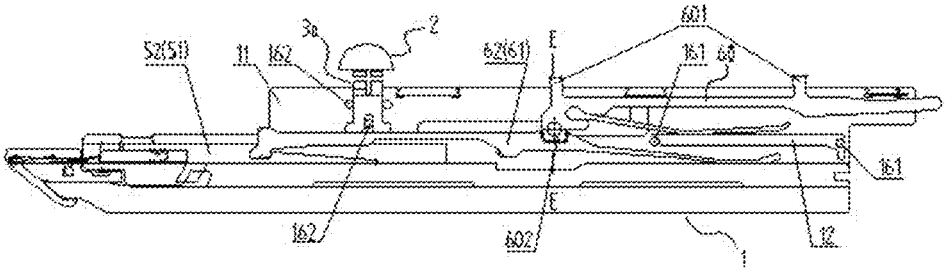
FIG. 7 is a structural view of the needle bed and needle combination according to Embodiment 2 of the present disclosure.

The two elastic stitch elements 61, 62 are connected to the two parallel knitting needles 51, 52, respectively. For example, as shown in FIG. 7, the two elastic stitch elements 61, 62 are engaged with the two parallel knitting needles 51, 52. In this way, the two elastic stitch elements 61, 62 are in one-to-one correspondence with the knitting needles 51, 52 and are arranged side by side in the needle groove 11. The jack 60 is located above the two elastic stitch elements 61, 62, and is engaged with the two elastic stitch elements 61, 62. In this embodiment, a support rod 12 supports the jack 60, such that the jack 60 is located above the two elastic stitch elements 61, 62. The support rod 12 is detachably provided in the needle groove 11 through two support steel wires 161 arranged on the needle bed. When it is necessary to select one of the knitting needles to work (i.e., to be ejected) while the other knitting needle is idled (i.e., not to be ejected), the needle selection unit operates on the elastic stitch element connected to the knitting needle that does not need to be ejected, such that the elastic stitch element is pressed and deformed elastically to disengage from the jack. As a result, the knitting needle is not connected to the jack 60 through the elastic stitch element and thus cannot be driven by the jack 60 to perform the knitting action. Since the other elastic stitch element is not operated on by the needle selection unit 3*a* and maintains the connection with the jack 60, then the elastic stitch element can be driven by the jack 60, so the knitting needles can make knitting actions including a knit stitch, a tuck stitch and a loop transfer stitch. When the two knitting needles do not need to be selected, that is, in a non-selection state, both of the two elastic stitch elements are not operated on by the needle selection unit, and the needle selection unit is in an initial state at this time.

Figure 8:
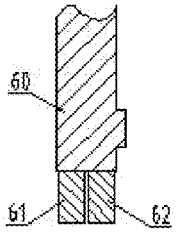
FIG. 8 is an E-E sectional view of the needle bed and needle combination shown in FIG. 7 (as well as FIGS. 19, 30, and 43).
Figure 9:
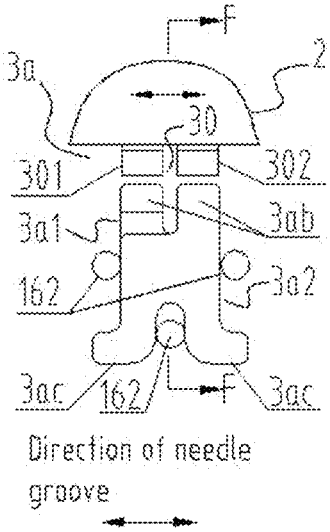
FIG. 9 is a structural view of a needle selection unit according to Embodiment 2 of the present disclosure.
Figure 10:
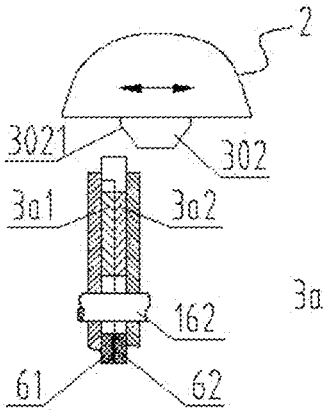
FIG. 10 is an F-direction sectional view of the needle selection unit shown in FIG. 9.

FIGS. 8 to 10 show the needle selection unit 3*a* of this embodiment. The needle selection unit 3*a* includes at least a control element 30, a first pressing piece 3*a*1, and a second pressing piece 3*a*2. The first pressing piece 3*a*1 is provided with a pressing portion configured to press the corresponding elastic stitch element and a first control portion configured to be operated on by the control element. Similarly, the second pressing piece 3*a*2 is provided with a pressing portion and a second control portion configured to be operated on by the control element. The two pressing pieces are respectively arranged above the corresponding elastic stitch elements, and the pressing portions of the two pressing pieces respectively face the corresponding elastic stitch elements. The first control portion and the second control portion are respectively located at different positions staggered from each other in a length direction of the needle groove, so as to be respectively operated on by the control element and moved downward after being operated on.

Figure 11:
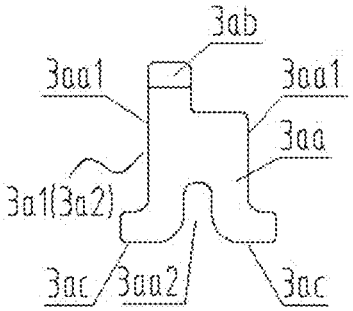
FIG. 11 is a structural view of a pressing piece including a main body and a protrusion.
Figure 12:
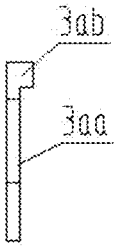
FIG. 12 is a left view of the pressing piece shown in FIG. 11.

As shown in FIGS. 11 and 12, in this embodiment, the first pressing piece 3*a*1 and the second pressing piece 3*a*2 have the same structure and shape, and each of the first pressing piece 3*a*1 and the second pressing piece 3*a*2 includes a main body 3*aa* and a protrusion 3*ab*. The protrusion 3*ab* of the first pressing piece and the protrusion 3*ab* of the second pressing piece are provided at a side of upper ends of corresponding main bodies 3*aa* respectively to form a first control portion of the first pressing piece and a second control portion of the second pressing piece. A lower side of the main body of each of the first pressing piece and the second pressing piece forms a corresponding pressing portion 3*ac*. The first pressing piece 3*a*1 and the second pressing piece 3*a*2 are arranged side by side in the needle groove, with respective main bodies overlapped with each other. In this way, the protrusion 3*ab* of the first pressing piece and the protrusion 3*ab* of the second pressing piece are located at an upper left end of the first pressing piece 3*a*1 and an upper right end of the second pressing piece 3*a*2, respectively, and staggered from each other in a direction of the needle groove. Moreover, the first pressing piece 3*a*1 and the second pressing piece 3*a*2 are located above the elastic stitch elements 61, 62, respectively.

Figure 13:
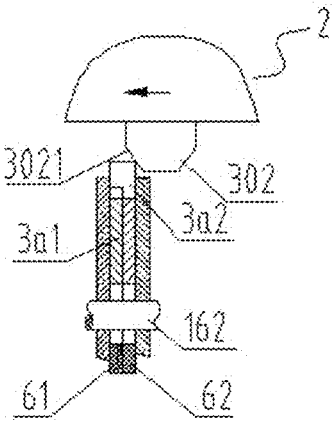
FIG. 13 is a schematic view showing that a pressing plate of the needle selection unit shown in FIG. 9 moves downward, such that an inclined surface of the pressing plate presses a protrusion of the corresponding second pressing piece.
Figure 14:
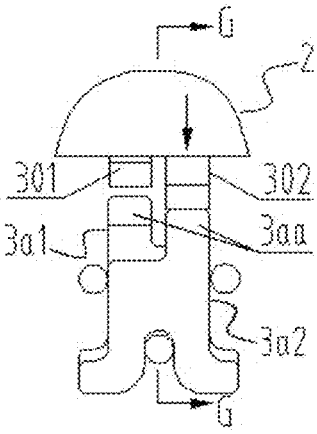
FIG. 14 is a schematic view showing that the second pressing piece shown in FIG. 13 is completely pressed down by the inclined surface of the pressing plate.
Figure 15:
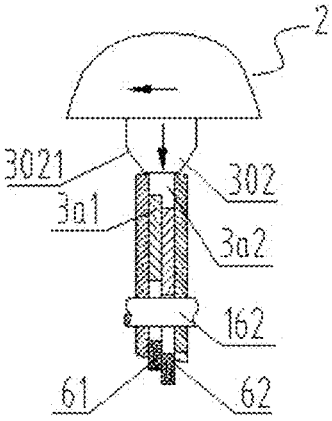
FIG. 15 is a G-direction sectional view of the needle selection unit shown in FIG. 14.
Figure 16:
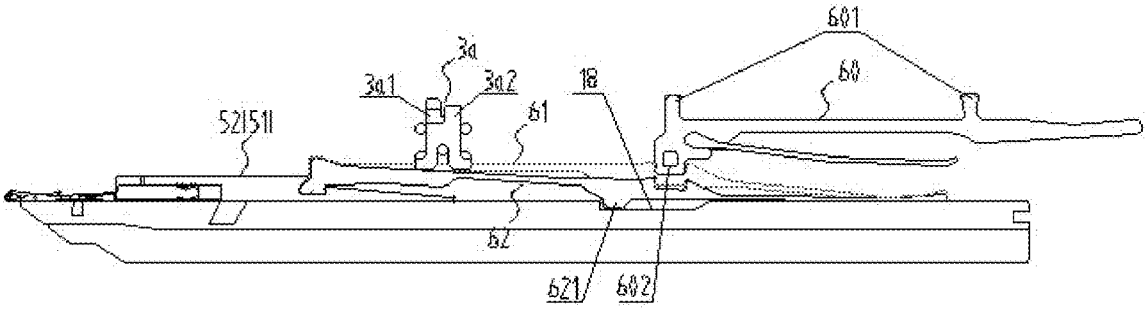
FIG. 16 is a schematic view showing that an elastic stitch element is deformed elastically to disengage from a jack under an operation of the needle selection unit shown in FIG. 9.
Figure 17:
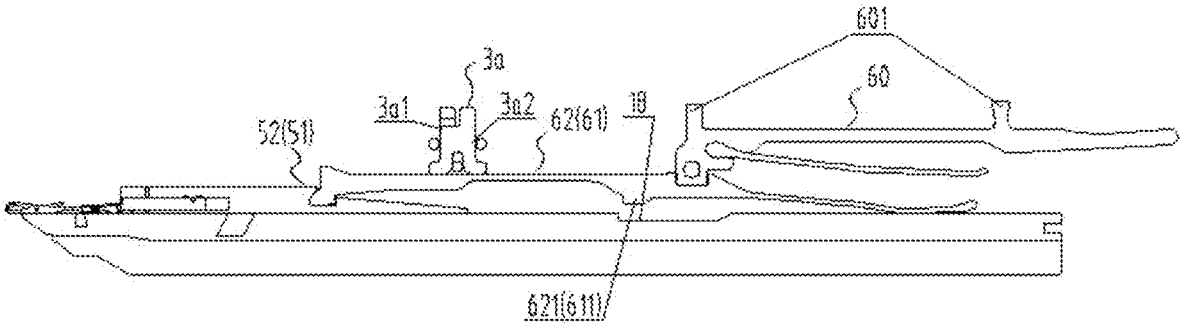
FIG. 17 is a schematic view showing that the needle selection unit shown in FIG. 9 is restored to an original state after removal of the operation on the elastic stitch element.
Figure 18:
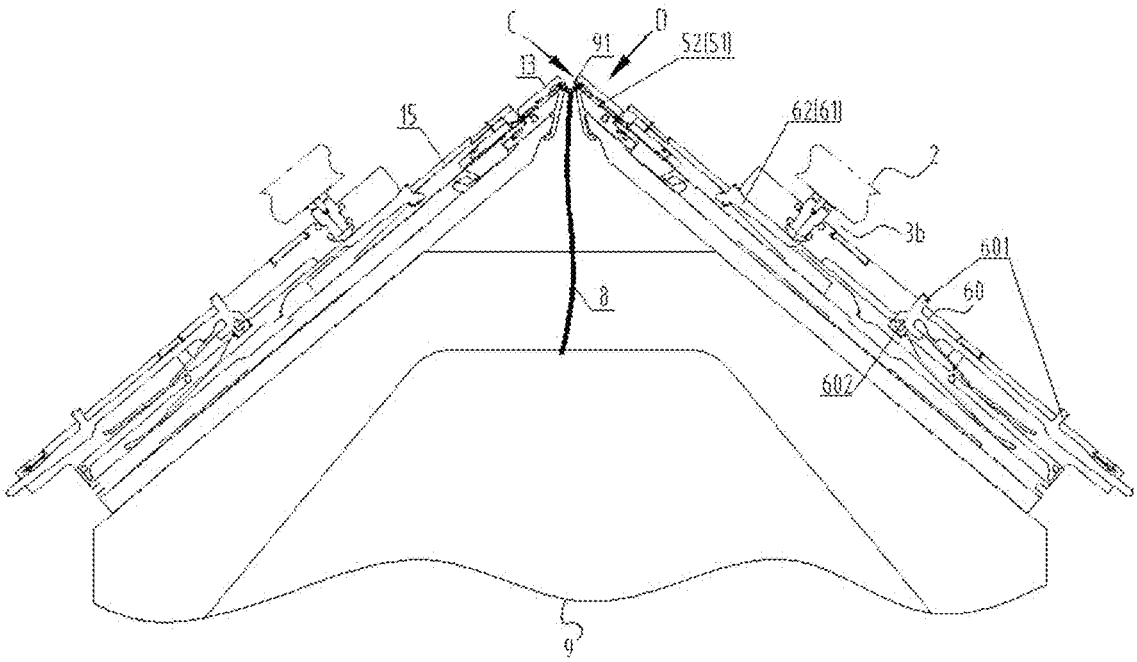
FIG. 18 is a structural view of a needle bed and needle combination provided on a flat knitting machine according to Embodiment 3 of the present disclosure.
Figure 19:
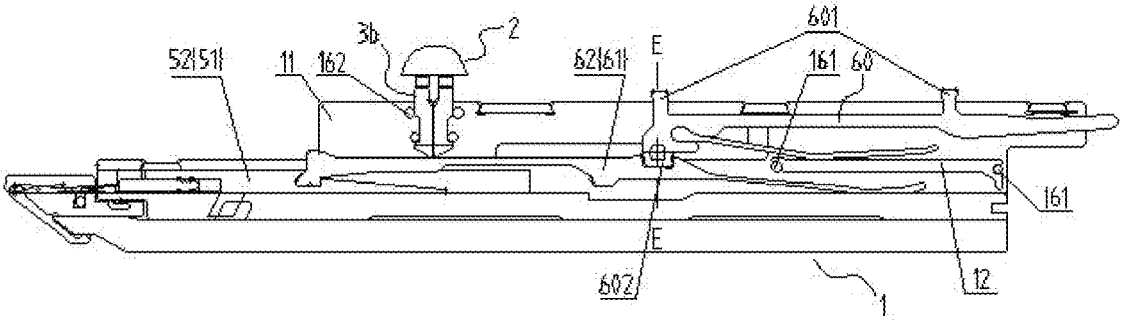
FIG. 19 is a structural view of the needle bed and needle combination according to Embodiment 3 of the present disclosure.

In this embodiment, the control elements are two pressing plates 301, 302 provided on a cam plate 2 of the flat knitting machine at positions corresponding to the first pressing piece and the second pressing piece, respectively, and adjustable up and down. Each of the two pressing plates is provided with an inclined surface configured to press the pressing piece. When moving with the cam plate, the pressing plate operates on the control portion (that is the corresponding protrusion 3*ab*) through the inclined surface to move the corresponding pressing piece downward. As shown in FIGS. 13 to 15, if it is necessary to eject the knitting needle 51 while maintaining the knitting needle 52 to be idled, the second pressing plate 302, located above the elastic stitch element 62 that is connected to the knitting needle 52, moves downward, such that the inclined surface 3021 of the second pressing plate 302 presses against the corresponding protrusion 3*ab* of the second pressing piece 3*a*2. When moving with the cam plate, the pressing plate 302 completely presses down the second pressing piece 3*a*2, and the elastic stitch element 62 is deformed elastically to disengage from the jack 60, as shown in FIG. 16. After the pressing operation of the control element on the pressing piece is removed, a returning force of elastic deformation of the elastic stitch element makes the corresponding pressing piece return to an original position, and the needle selection unit 3*a* returns to an initial state, as shown in FIG. 17.

The two pressing pieces are movable up and down in the needle groove 11. The corresponding main body 3*aa* is provided with vertical guide surfaces 3*aa*1 on left and right sides and a vertical guide groove 3*aa*2 at a lower central position. The guide groove 3*aa*2 divides the first pressing portion and the second pressing portion at a lower side of the first pressing piece or the second pressing piece into two parts. The main body has a thickness of not greater than half a width of the needle groove. In order to make the two pressing pieces movable up and down stably in the needle groove, an upper end of the protrusion 3*ab* has a thickness adapted to the width of the needle groove, such that the protrusion 3*ab* is guided by the needle groove. Guide steel wires 162 are arranged on the needle bed, which correspond to the two guide surfaces 3*aa*1 and the guide groove 3*aa*2, respectively. The first pressing piece 3*a*1 or the second pressing piece 3*a*2 is movable up and down along the guide steel wires 162.

Lower sides of the elastic stitch elements are provided with limiting protrusions 611, 621, respectively. The bottom of the needle groove is provided with a limiting groove 18. When the elastic stitch element falls into the limiting groove due to elastic deformation, the limiting groove limits front-back movement of the elastic stitch element.

Similarly, front ends of the two parallel knitting needles provided in the same needle groove are positioned in close proximity to a strip-shaped opening 91 formed by the sinkers 13 and the front end of the needle bed 1 for forming a knitted fabric 8.

Embodiment 3

As shown in FIGS. 18, 19, 5, 6, and 8, as in Embodiment 2, the needle bed and needle combination includes a needle bed 1 provided with a plurality of parallel needle grooves 11, a plurality of parallel sinkers 13 provided at a front end of the needle bed, and knitting needles 51, 52 provided in the needle grooves. The needle bed and needle combinations are provided on each of the front and back sides of a frame 9 of a flat knitting machine through the needle bed 1. One needle groove 11 is provided between every two sinkers on the needle bed, and two knitting needles 51, 52 are arranged on the left and right in the same needle groove 11 in a width direction of the needle groove. When the two knitting needles perform their separate knitting actions, a needle selection unit 3*b* cooperates with a composite stitch element that includes elastic stitch elements 61, 62 and a jack 60 to select one of the knitting needles to work (i.e., to be ejected) while the other is idled. In this way, the two parallel knitting needles in the same needle groove can separately make knitting actions including a knit stitch, a tuck stitch and a loop transfer stitch. Therefore, the needle bed and needle combinations of this embodiment and Embodiment 2 essentially only differ in the needle selection unit.

Figure 20:
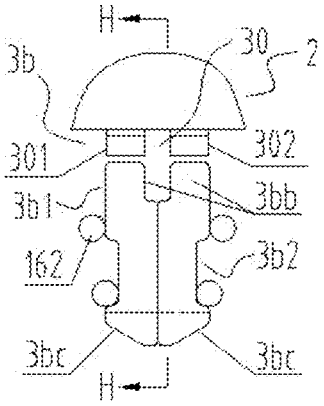
FIG. 20 is a structural view of a needle selection unit according to Embodiment 3 of the present disclosure.
Figure 21:
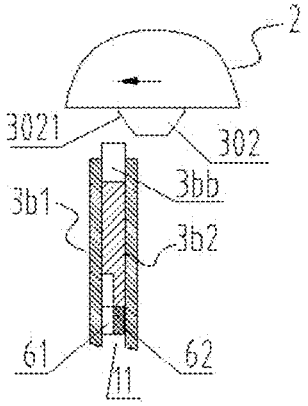
FIG. 21 is an H-direction sectional view of the needle selection unit shown in FIG. 20.

FIGS. 20 and 21 show the needle selection unit 3*b* of this embodiment. The needle selection unit 3*b* includes at least a control element 30, a first pressing piece 3*b*1, and a second pressing piece 3*b*2. The first pressing piece 3*b*1 is provided with a pressing portion configured to press the corresponding elastic stitch element and a first control portion configured to be operated on by the control element. Similarly, the second pressing piece 3*b*2 is provided with a pressing portion and a second control portion configured to be operated on by the control element. The two pressing pieces are respectively arranged above the corresponding elastic stitch elements, and the pressing portions of the two pressing pieces respectively face the corresponding elastic stitch elements. The first control portion and the second control portion are respectively located at different positions staggered from each other in a length direction of the needle groove, so as to be respectively operated on by the control element and moved downward after being operated on to press the corresponding elastic stitch elements.

Figure 22:
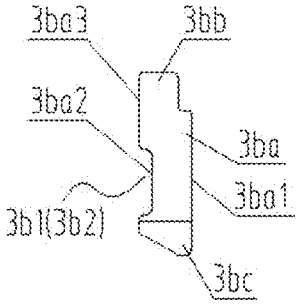
FIG. 22 is a structural view of a pressing piece.
Figure 23:
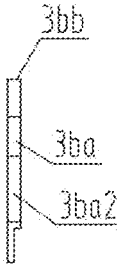
FIG. 23 is a left view of the pressing piece shown in FIG. 22.

As shown in FIGS. 22 and 23, in this embodiment, the first pressing piece 3*b*1 and the second pressing piece 3*b*2 have the same structure and shape, and each of the first pressing piece 3*b*1 and the second pressing piece 3*b*2 includes a main body 3*ba* and a protrusion 3*bb*. The protrusion 3*bb* is provided at a side of an upper end of the main body 3*ba* to form the control portion of the corresponding pressing piece. Both of the main body and the protrusion have a thickness adapted to a width of the needle groove, and a side of the lower side of the main body is provided with a recess to form a lower side edge that is not greater than half the width of the needle groove, thereby forming a pressing portion 3*bc* of the corresponding pressing piece. The main body is provided with guide surfaces 3*ba*2, 3*ba*3 and a sliding surface 3*ba*1 at left and right sides, respectively. The two pressing pieces symmetrically touch each other with the sliding surface 3*ba*1 as a symmetrical central surface and are arranged side by side in the needle groove, such that the protrusions 3*bb* and the guide surfaces 3*ba*2, 3*ba*3 of the two pressing pieces are arranged symmetrically with respect to the symmetrical central surface. The recess forming the pressing portion 3*bc* faces a central surface of the needle groove, and the respective pressing portion 3*bc* is located above the respective elastic stitch element. The needle bed is provided with guide steel wires 162 corresponding to a side of the guide surfaces of the two pressing pieces. The first pressing piece 3*b*1 is movable up and down along the guide steel wires 162 corresponding to a side of the guide surface of the first pressing piece 3*b*1 and the sliding surface of the second pressing piece 3*b*2. The second pressing piece 3*b*2 is movable up and down along the guide steel wires 162 corresponding to a side of the guide surface of the second pressing piece 3*b*2 and the sliding surface of the first pressing piece 3*b*1. Therefore, the two pressing pieces are movable up and down relative to each other.

Figure 24:
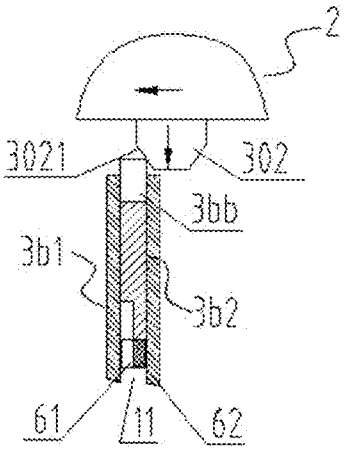
FIG. 24 is a schematic view showing that a pressing plate of the needle selection unit shown in FIG. 21 moves downward, such that an inclined surface of the pressing plate presses a protrusion of the corresponding second pressing piece.
Figure 25:
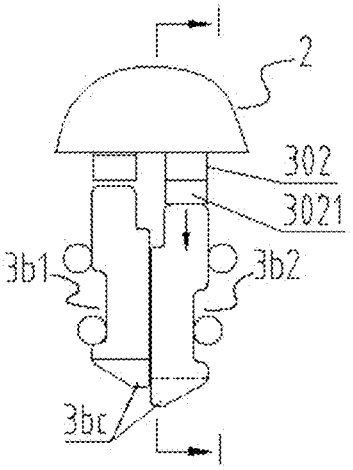
FIG. 25 is a schematic view showing that the second pressing piece shown in FIG. 24 is completely pressed down by the inclined surface of the pressing plate.
Figure 26:
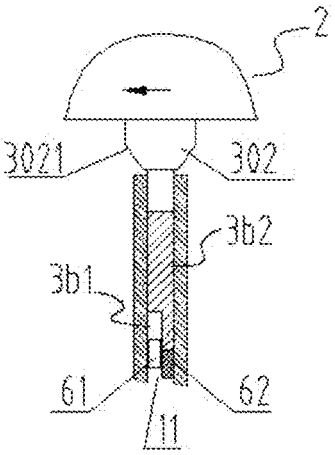
FIG. 26 is an I-direction sectional view of the needle selection unit shown in FIG. 25.
Figure 27:
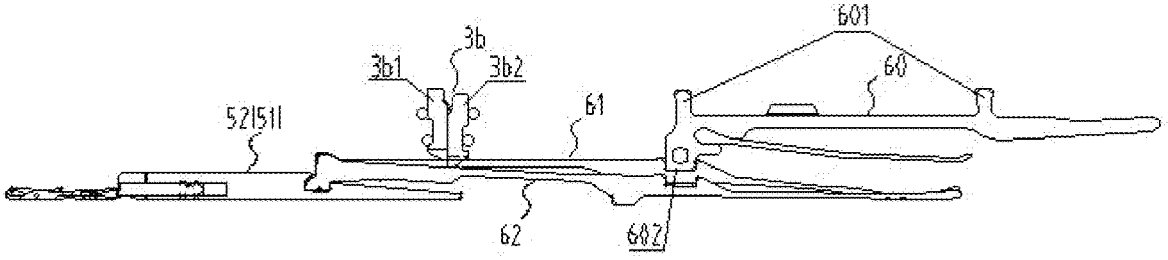
FIG. 27 is a schematic view showing that an elastic stitch element is deformed elastically to disengage from a jack under an operation of the needle selection unit shown in FIG. 20.
Figure 28:
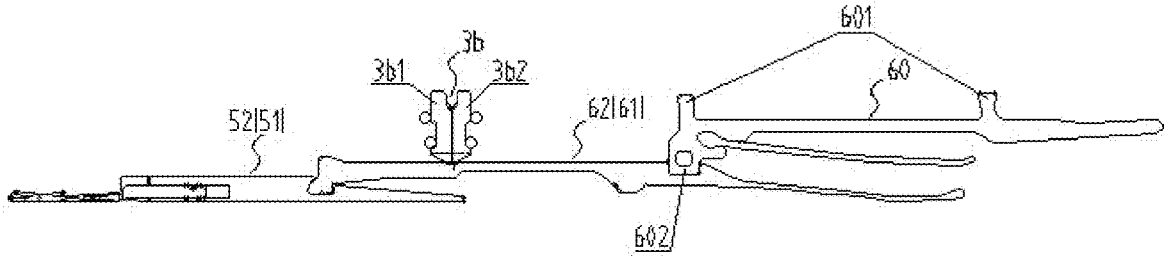
FIG. 28 is a schematic view showing that the needle selection unit shown in FIG. 20 is restored to an original state after removal of the operation on the elastic stitch element.
Figure 29:
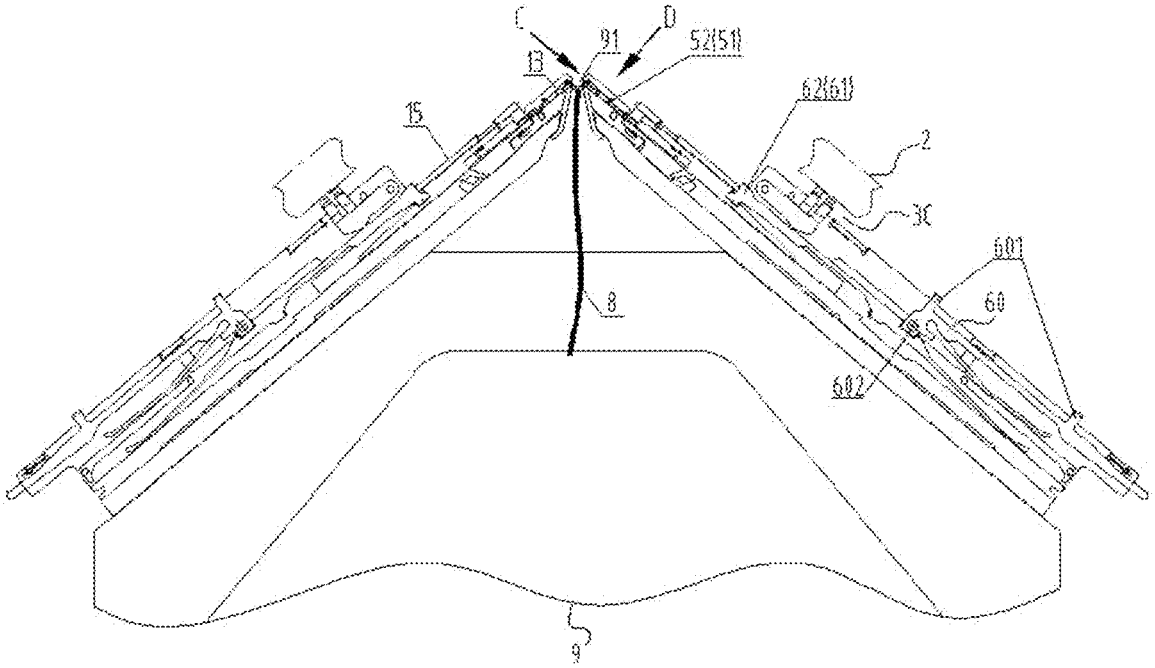
FIG. 29 is a structural view of a needle bed and needle combination provided on a flat knitting machine according to Embodiment 4 of the present disclosure.
Figure 30:
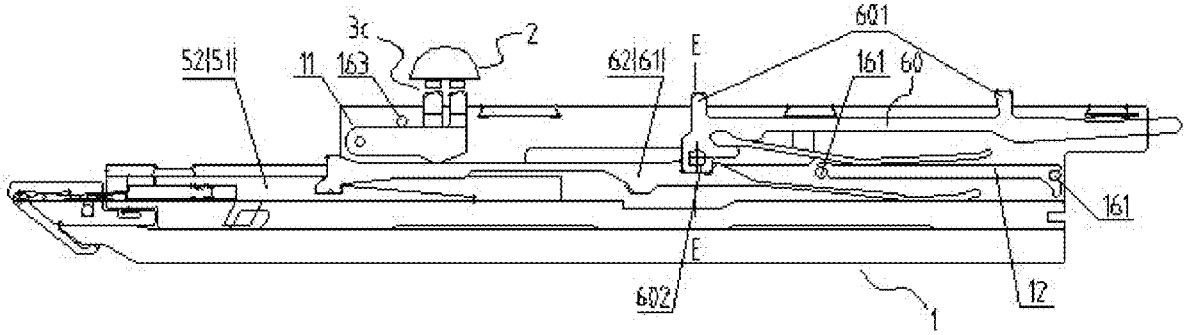
FIG. 30 is a structural view of the needle bed and needle combination according to Embodiment 4 of the present disclosure.

Similarly, in this embodiment, the control elements are two pressing plates 301, 302 provided on a cam plate of the flat knitting machine at positions corresponding to the first pressing piece 3*b*1 and the second pressing piece 3*b*2, respectively, and adjustable up and down. Each of the two pressing plates is provided with an inclined surface. When moving with the cam plate, the pressing plate operates on the control portion (that is the corresponding protrusion 3*bb*) through the inclined surface. For example, if it is necessary to eject the knitting needle 51 while maintaining the knitting needle 52 to be idled, the second pressing plate 302, located above the elastic stitch element 62 that is connected to the knitting needle 52, moves downward, as shown in FIG. 24, such that the inclined surface 3021 of the second pressing plate 302 presses against the corresponding protrusion 3*bb* of the second pressing piece 3*b*2. When moving with the cam plate, the pressing plate 302 completely presses down the second pressing piece **3*b*2, as shown in FIGS. 25 and 26, and the elastic stitch element 62 is deformed elastically to disengage from the jack 60, as shown in FIG. 27. When the pressing operation of the pressing plate 302 on the pressing piece is removed, a returning force of elastic deformation of the elastic stitch element 62 makes the second pressing piece 3*b*2 return to an original position, and the needle selection unit 3*b* returns to an initial state, as shown in FIG. 28**.

Other structures and corresponding working principles of the needle bed and needle combination in this embodiment are the same as those in Embodiment 2 and are not repeated herein.

Embodiment 4

As shown in FIGS. 29, 30, 5, 6, and 8, as in Embodiment 2 or Embodiment 3, the needle bed and needle combination includes a needle bed 1 provided with a plurality of parallel needle grooves 11, a plurality of parallel sinkers 13 provided at a front end of the needle bed, and knitting needles 51, 52 provided in the needle grooves. The needle bed and needle combinations are provided on each of the front and back sides of a frame 9 of a flat knitting machine through the needle bed 1. One needle groove 11 is provided between every two sinkers on the needle bed, and two parallel knitting needles 51, 52 are arranged on the left and right in the same needle groove 11 in a width direction of the needle groove. When the two knitting needles perform their separate knitting actions, a needle selection unit **3*c* cooperates with a composite stitch element that includes elastic stitch elements 61, 62 and a jack 60** to select one of the knitting needles to work (i.e., to be ejected) while the other is idled. In this way, the two parallel knitting needles in the same needle groove can separately make knitting actions including a knit stitch, a tuck stitch and a loop transfer stitch. Therefore, the needle bed and needle combinations of this embodiment and Embodiment 2 or Embodiment 3 essentially only differ in the needle selection unit.

Figure 31:
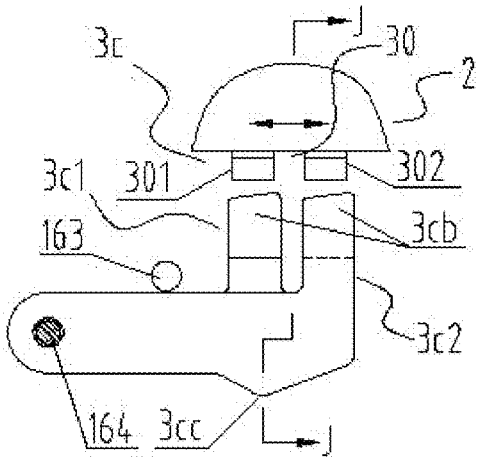
FIG. 31 is a structural view of a needle selection unit according to Embodiment 4 of the present disclosure.
Figure 32:
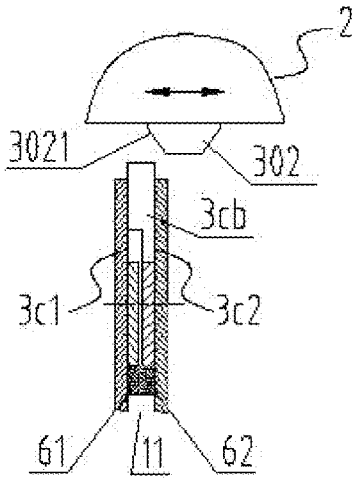
FIG. 32 is a J-direction sectional view of the needle selection unit shown in FIG. 31.
Figure 33:
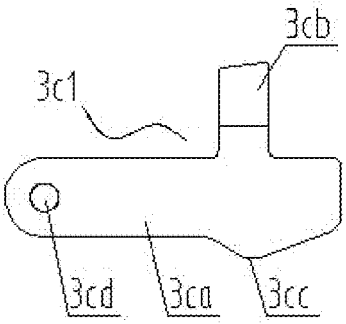
FIG. 33 is a structural view of a first pressing piece.
Figure 34:
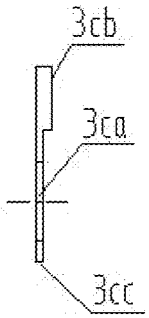
FIG. 34 is a left view of the first pressing piece shown in FIG. 33.
Figure 35:
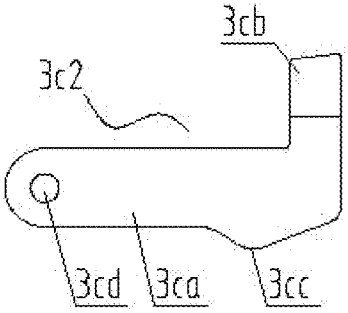
FIG. 35 is a structural view of a second pressing piece.
Figure 36:
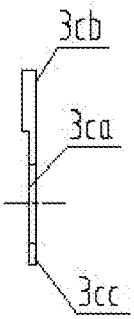
FIG. 36 is a left view of the second pressing piece shown in FIG. 35.

FIGS. 31 and 32 show the needle selection unit **3*c* of this embodiment. The needle selection unit 3*c* includes at least a control element 30, a first pressing piece 3*c*1, and a second pressing piece 3*c*2. The first pressing piece 3*c*1 is provided with a pressing portion configured to press the corresponding elastic stitch element and a first control portion configured to be operated on by the control element. Similarly, the second pressing piece 3*c*2** is provided with a pressing portion and a second control portion configured to be operated on by the control element. The two pressing pieces are respectively arranged above the corresponding elastic stitch elements, and the pressing portions of the two pressing pieces respectively face the corresponding elastic stitch elements. The first control portion and the second control portion are respectively located at different positions staggered from each other in a length direction of the needle groove, so as to be respectively operated on by the control element and rotate the corresponding pressing pieces downward after being operated on to press the corresponding elastic stitch elements.

As shown in FIGS. 33 to 36, in this embodiment, the first pressing piece **3*c*1 and the second pressing piece 3*c*2 are provided coaxially rotatable in the needle groove 11. The first pressing piece 3*c*1 and the second pressing piece 3*c*2 have the same structure and shape, and each of the first pressing piece 3*c*1 and the second pressing piece 3*c*2 includes a main body 3*ca* and a protrusion 3*cb*. The protrusion 3*cb* of the first pressing piece is provided at an upper center right side position of the corresponding main body to form the first control portion of the first pressing piece. The protrusion 3*cb* of the second pressing piece is provided at an upper right end position of the corresponding main body to form the second control portion of the second pressing piece. Lower sides of the main bodies 3*ca* of the two pressing pieces are provided with pressing portions 3*cc* in a downwardly contracted triangular shape. The main body 3*ca* has a thickness of not greater than half a width of the needle groove. The protrusion 3*cb* is provided with an L-shaped recess surface opposite to an inner side of the needle groove. An upper end of the protrusion has a thickness adapted to the width of the needle groove. The L-shaped recess surfaces on the two pressing pieces are symmetrically arranged with respect to a central surface of the needle groove. When the main bodies 3*ca* of the two pressing pieces are overlapped side by side, the protrusions 3*cb* of the two pressing pieces are located at staggered positions. The two pressing pieces are respectively provided with rotating holes at identical positions on the same side. The needle bed is provided with a rotating steel wire 164 corresponding to the rotating holes, and provided with a limiting steel wire 163 located above upper sides of the two pressing pieces. The first pressing piece and the second pressing piece are provided in the needle groove 11 and rotatable by the rotating steel wire 164 passing through the rotating holes 3*cd*. The limiting steel wire 163 limits movement of the two pressing pieces 3*c*1, 3*c*2 caused by a returning force of the elastic stitch elements 61, 62**.

Figure 37:
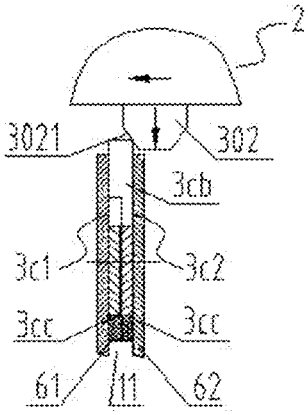
FIG. 37 is a schematic view showing that a pressing plate of the needle selection unit shown in FIG. 31 moves downward, such that an inclined surface of the pressing plate presses a protrusion of the corresponding second pressing piece.
Figure 38:
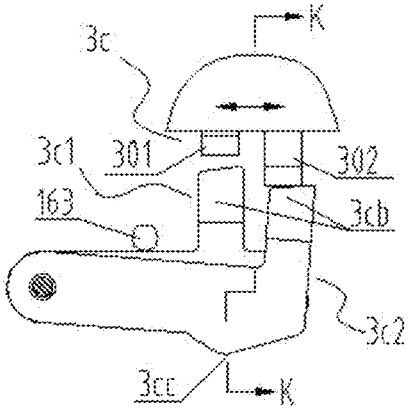
FIG. 38 is a schematic view showing that the second pressing piece shown in FIG. 37 is completely pressed down by the inclined surface of the pressing plate.
Figure 39:
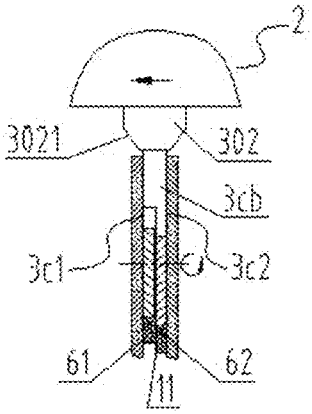
FIG. 39 is a K-direction sectional view of the needle selection unit shown in FIG. 38.
Figure 40:
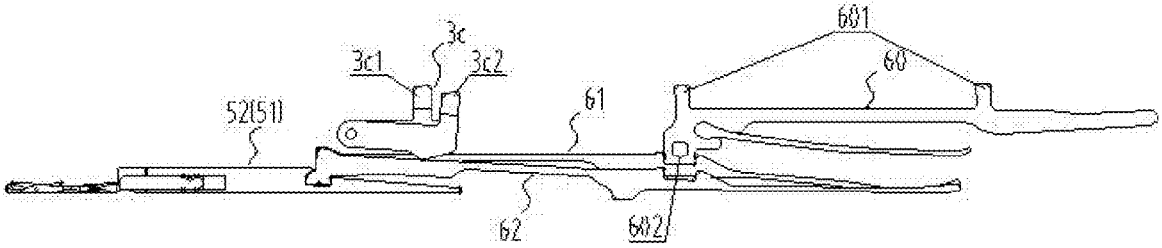
FIG. 40 is a schematic view showing that an elastic stitch element is deformed elastically to disengage from a jack under an operation of the needle selection unit shown in FIG. 31.
Figure 41:
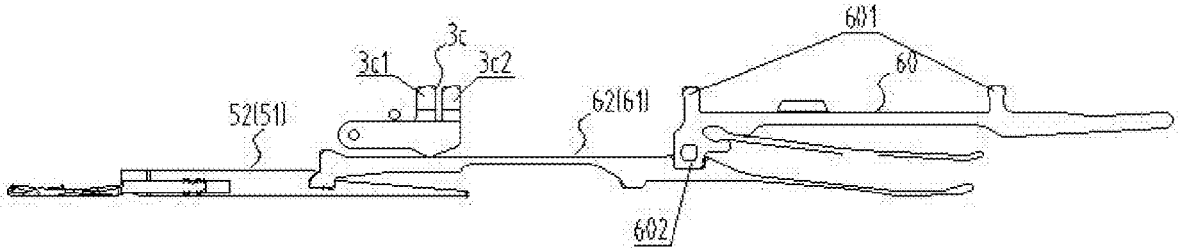
FIG. 41 is a schematic view showing that the needle selection unit shown in FIG. 31 is restored to an original state after removal of the operation on the elastic stitch element.
Figure 42:
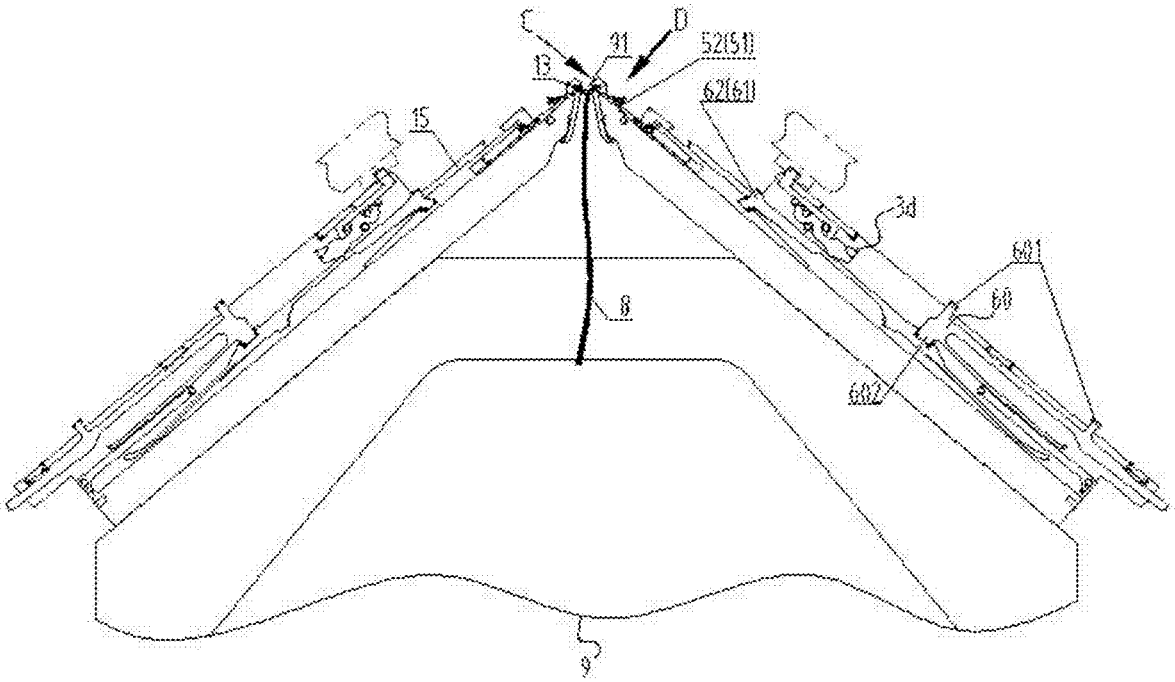
FIG. 42 is a structural view of a needle bed and needle combination provided on a flat knitting machine according to Embodiment 5 of the present disclosure.
Figure 43:
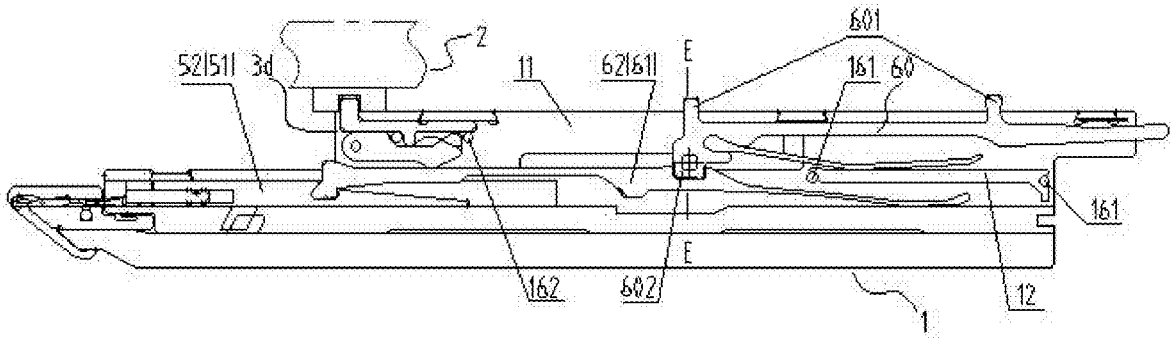
FIG. 43 is a structural view of the needle bed and needle combination according to Embodiment 5 of the present disclosure.
Figure 44:
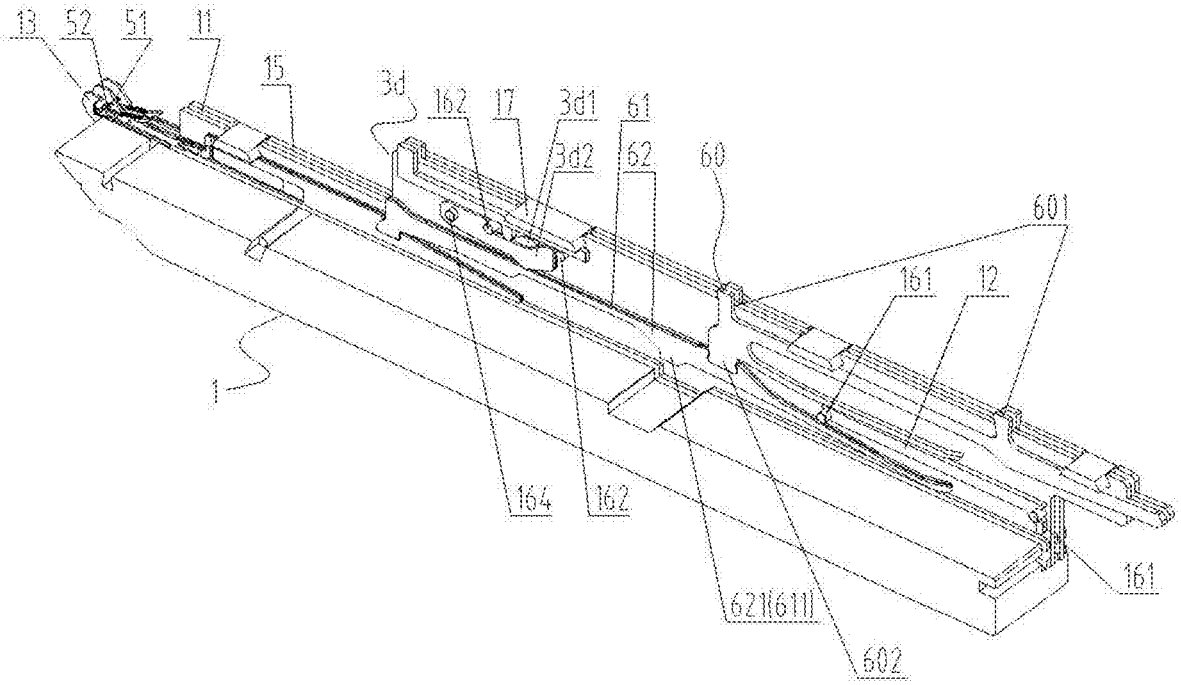
FIG. 44 is a three-dimensional structural view of the needle bed and needle combination according to Embodiment 5 of the present disclosure.

Similarly, in this embodiment, the control elements are two pressing plates 301, 302 provided on a cam plate 2 of the flat knitting machine at positions corresponding to the two pressing pieces, respectively. Each of the two pressing plates is provided with an inclined surface. If it is necessary to eject the knitting needle 51 while maintaining the knitting needle 52 to be idled, the second pressing plate 302, located above the elastic stitch element 62 that is connected to the knitting needle 52, moves downward, such that the inclined surface 3021 of the second pressing plate 302 presses against the corresponding protrusion **3*cb* of the second pressing piece 3*c*2, as shown in FIG. 37. When moving with the cam plate, the second pressing plate 302 operates on the protrusion 3*cb* of the second pressing piece 3*c*2 through the inclined surface to rotate the second pressing piece 3*c*2 until a lower end surface of the second pressing plate 302 completely presses the second pressing piece 3*c*2, as shown in FIGS. 38 and 39. The elastic stitch element 62 is pressed to be deformed elastically to disengage from the jack 60, as shown in FIG. 40. When the pressing operation of the second pressing plate 302 on the pressing piece 3*c*2 is removed, a returning force of elastic deformation of the elastic stitch element 62 makes the pressing piece 3*c*2 return to an original position, and the needle selection unit 3*c* returns to an initial state, as shown in FIG. 41**.

Other structures and corresponding working principles of the needle bed and needle combination in this embodiment are the same as those in Embodiment 2 and are not repeated herein.

Embodiment 5

As shown in FIGS. 42, 43, 44, 5, 6, and 8, as in Embodiments 2 to 4, the needle bed and needle combination includes a needle bed 1 provided with a plurality of parallel needle grooves 11, a plurality of parallel sinkers 13 provided at a front end of the needle bed, and knitting needles 51, 52 provided in the needle grooves. The needle bed and needle combinations are provided on each of the front and back sides of a frame 9 of a flat knitting machine through the needle bed 1. One needle groove 11 is provided between every two sinkers on the needle bed, and two knitting needles 51, 52 are arranged on the left and right in the same needle groove 11 in a width direction of the needle groove. When the two knitting needles perform their separate knitting actions, a needle selection unit 3*d* cooperates with a composite stitch element that includes elastic stitch elements 61, 62 and a jack 60 to select one of the knitting needles to work (i.e., to be ejected) while the other is idled. In this way, the two parallel knitting needles in the same needle groove can separately make knitting actions including a knit stitch, a tuck stitch and a loop transfer stitch. Therefore, the needle bed and needle combinations of this embodiment and Embodiment 2 essentially only differ in the needle selection unit.

Figure 45:
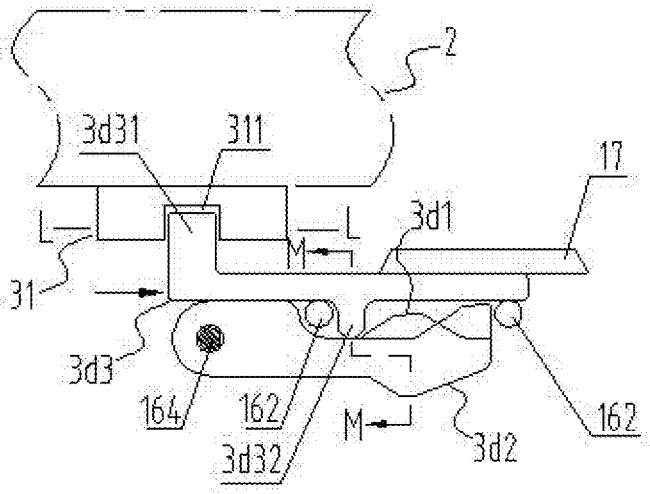
FIG. 45 is a structural view of a needle selection unit according to Embodiment 5 of the present disclosure.
Figure 46:
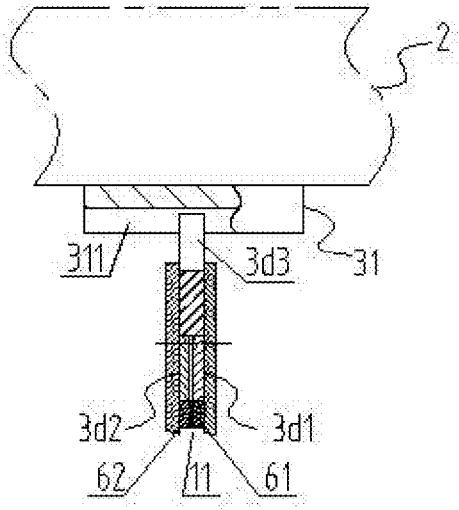
FIG. 46 is an M-direction sectional view of the needle selection unit shown in FIG. 45.

FIGS. 45 and 46 show the needle selection unit 3*d* of this embodiment. In addition to including a control element 31, a first pressing piece 3*d*1, a second pressing piece 3*d*2 as in Embodiment 4, the needle selection unit 3*d* further includes a push piece 3*d*3. Similarly, the first pressing piece 3*d*1 is provided with a pressing portion and a first control portion configured to be operated on by the control element, and the second pressing piece 3*d*2 is provided with a pressing portion and a second control portion configured to be operated on by the control element. The two pressing pieces are respectively arranged above the corresponding elastic stitch elements 61, 62. The first control portion and the second control portion are respectively located at different positions staggered from each other in a length direction of the needle groove. The control element operates on the first control portion or the second control portion through the push piece 3*d*3. After being operated on, the first control portion or the second control portion rotates the corresponding pressing piece downward so as to press the corresponding elastic stitch element.

Figure 47:
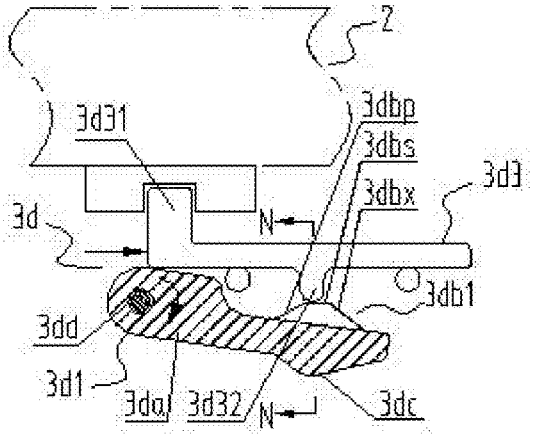
FIG. 47 is a schematic view showing that the first pressing piece is operated on by a push piece and is completely pressed down by a push pin.
Figure 48:
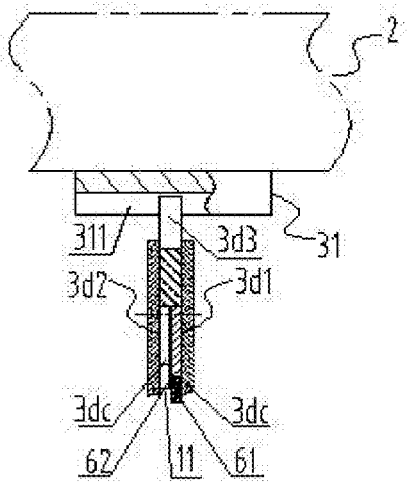
FIG. 48 is an N-direction sectional view of the push piece and the first pressing piece shown in FIG. 47.

As shown in FIGS. 47 and 48, as in Embodiment 4, in this embodiment, the first pressing piece 3*d*1 and the second pressing piece 3*d*2 are provided coaxially rotatable in the needle groove 11, and each of the first pressing piece 3*d*1 and the second pressing piece 3*d*2 includes a main body 3*da* and a protrusion. The main bodies 3*da* of the first pressing piece 3*d*1 and the second pressing piece 3*d*2 have the same structure and shape (such as the hatched portion of the first pressing piece in FIG. 47), but the corresponding protrusions are different in structure, that is, there are two types of protrusions, a first protrusion 3*db*1 and a second protrusion 3*db*2. The first protrusion 3*db*1 is provided with a climbing surface 3*dbp*, a descending surface 3*dbx*, and an upper end surface 3*dbs* connecting upper ends of the climbing surface and the descending surface. The second protrusion is provided with at least a climbing surface 3*dbp* and an upper end surface 3*dbs* connected to an upper end of the climbing surface. Furthermore, a distance between the first protrusion and the rotation center is smaller than a distance between the second protrusion and the rotation center. Lower sides of the main bodies 3*da* of the two pressing pieces are provided with pressing portions 3*dc* in a downwardly contracted triangular shape, and the pressing portions 3*dc* are located above the corresponding elastic stitch elements 61, 62. In this embodiment, a first protrusion 3*db*1 and a second protrusion 3*db*2 are provided on upper sides of the main bodies 3*da* of the first pressing piece 3*d*1 and the second pressing piece 3*d*2, respectively. Rotating holes 3*dd* are respectively provided at identical positions on the same side of the main bodies of the two pressing pieces. A rotating steel wire 164 is provided at a position of the needle bed 1 corresponding to the rotating holes 3*dd* of the two pressing pieces, such that the two pressing pieces are provided coaxially rotatable in the needle groove 11 by the rotating steel wire 164 passing through the rotating holes.

The push piece 3*d*3 is provided above the first pressing piece 3*d*1 and the second pressing piece 3*d*2. The push piece has a thickness adapted to a width of the needle groove. The push piece 3*d*3 is provided with a needle butt 3*d*31 and a push pin 3*d*32 at upper and lower sides, respectively. The corresponding main bodies 3*da* and protrusions of the two pressing pieces have the same thickness, which is not greater than half a width of the needle groove. When the main bodies 3*da* of the two pressing pieces are overlapped side by side, the protrusions 3*db* of the two pressing pieces are located at staggered positions, so as to be operated on by the push pin 3*d*32 of the push piece separately. The upper and lower sides of the push piece 3*d*3 are respectively provided with a stopper 17 and guide steel wires 162, such that the push piece is slidable between the stopper and the guide steel wires 162. The first pressing piece 3*d*1 and the second pressing piece 3*d*2 are provided in the needle groove 11 and rotatable by the rotating steel wire 164 passing through the rotating holes 3*dd*.

Figure 49:
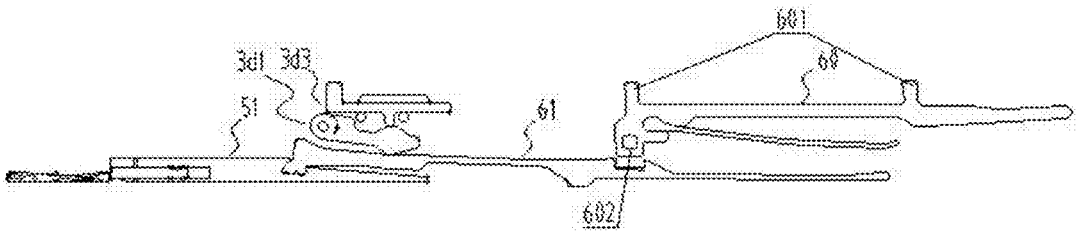
FIG. 49 is a schematic view showing that an elastic stitch element is deformed elastically to disengage from a jack under an operation of the needle selection unit shown in FIG. 45.
Figure 50:
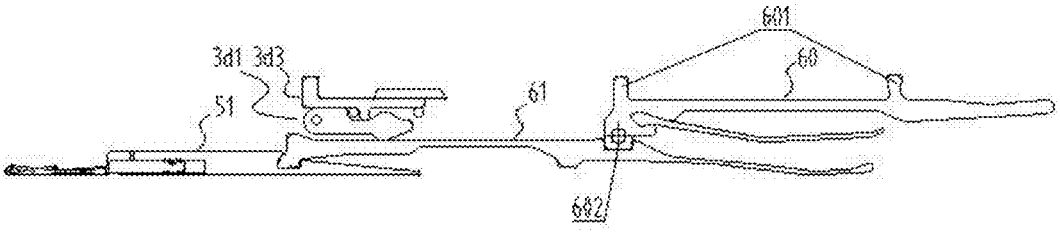
FIG. 50 is a schematic view showing that the needle selection unit shown in FIG. 45 is restored to an original state after removal of the operation on the elastic stitch element.
Figure 51:
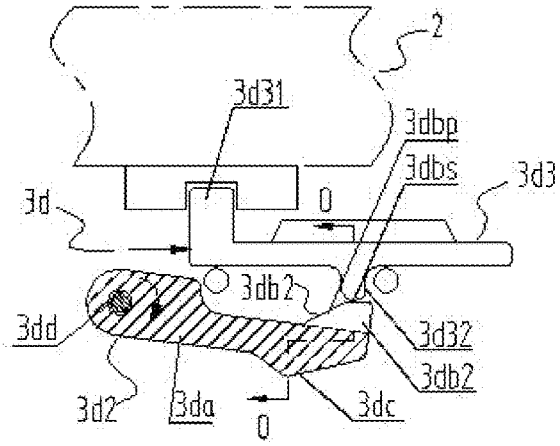
FIG. 51 is a schematic view showing that the second pressing piece is operated on by the push piece.
Figure 52:
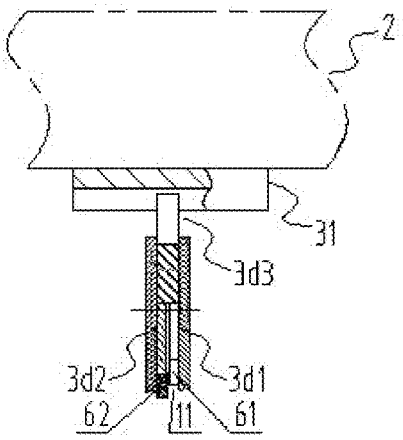
FIG. 52 is an O-direction sectional view of the push piece and the second pressing piece shown in FIG. 51.

In this embodiment, the control element 31 is a push plate 31 provided on a cam plate of the flat knitting machine, and movable in a direction of the needle groove. The push plate 31 is provided with a guide groove 311 adapted to the needle butt. When the corresponding push plate moves with the cam plate, the needle butt of the push piece is inserted into the push plate through the guide groove. The push plate 31 is movable in the direction of the needle groove to move the push piece 3*d*3 to an initial position where the push pin 3*d*32 of the push piece 3*d*3 does not touch the first protrusion or the second protrusion, as shown in FIGS. 45 and 46. The push piece 3*d*3 is also moved to a position where the push pin 3*d*32 of the push piece 3*d*3 touches the first protrusion 3*db*1, as shown in FIGS. 47 and 48. The push pin 3*d*32 touches the climbing surface of the first protrusion to rotate the first pressing piece 3*d*1 downward until the push pin 3*d*32 operates on the upper end surface 3*dbs* along the climbing surface 3*dbp*, such that the pressing portion of the first pressing piece is at a lowermost position, thereby pressing the elastic stitch element 61 below to produce maximum elastic deformation to disengage from the jack 60, as shown in FIG. 49. When the push pin of the push plate leaves the upper end surface and moves forward, since the front side of the upper end surface is the descending surface that is lower than the upper end surface, the pressing operation of the push piece on the first pressing piece is removed, the elastic stitch element 61 is no longer pressed by the first pressing piece, and the pressing piece returns to an original position due to a returning force of elastic deformation of the elastic stitch element 61, as shown in FIG. 50. The push plate 31 is also moved to a position where the push pin 3*d*32 touches the second protrusion 3*db*2, as shown in FIGS. 51 and 52. The push pin touches the climbing surface of the second protrusion to rotate the second pressing piece 3*d*2 downward until the second pressing piece 3*d*2 presses against the corresponding upper end surface, such that the corresponding elastic stitch element 62 is deformed elastically to disengage from the corresponding jack 60. When the push pin of the push plate leaves the second protrusion, that is, when the push pin of the push plate is completely separated from the second pressing piece 3*d*2, the pressing operation of the push piece on the second pressing piece is removed, the elastic stitch element 62 is no longer pressed by the second pressing piece, and the pressing piece returns to an original position due to a returning force of elastic deformation of the elastic stitch element 62.

Other structures and corresponding working principles of the needle bed and needle combination in this embodiment are the same as those in Embodiment 2 and are not repeated herein.

Embodiment 6

Figure 53:
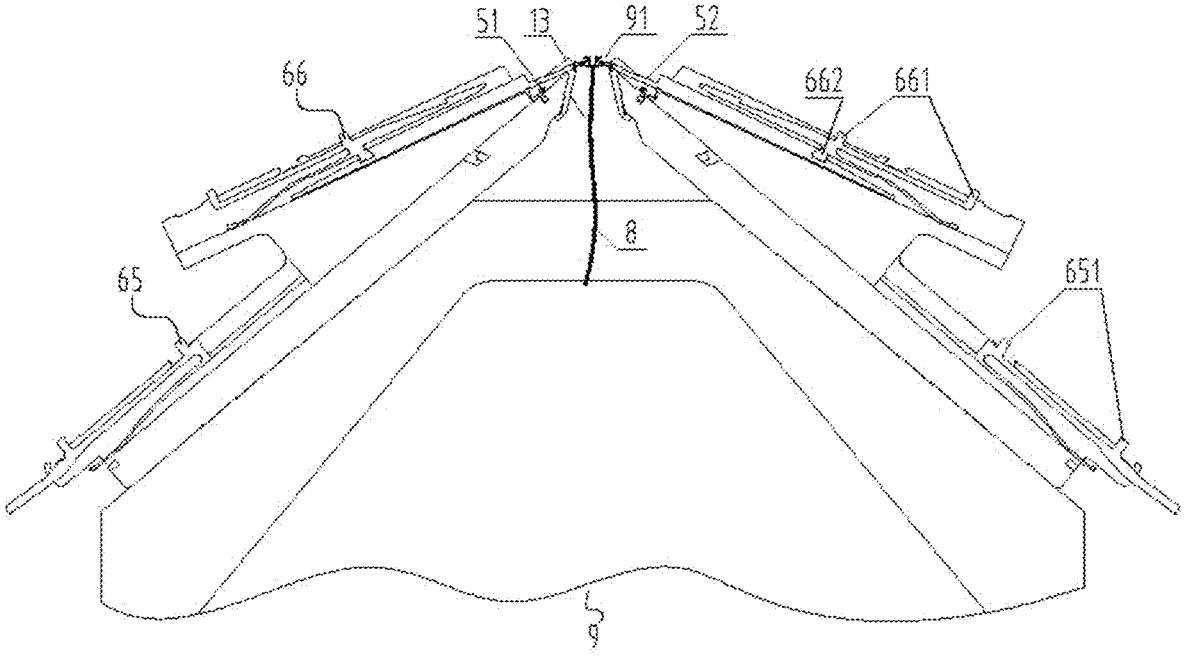
FIG. 53 is a structural view of a needle bed and needle combination provided on a flat knitting machine according to Embodiment 6 of the present disclosure.
Figure 54:
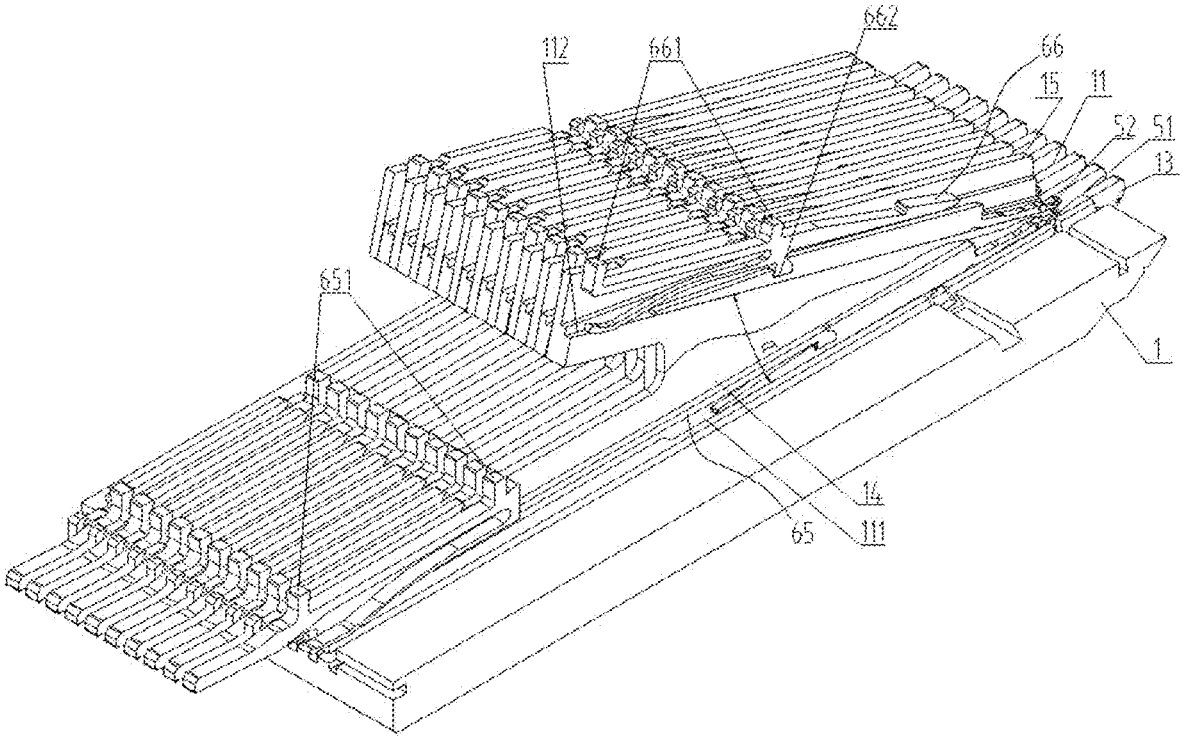
FIG. 54 is a structural view of the needle bed and needle combination according to Embodiment 6 of the present disclosure.

As shown in FIGS. 53 and 54, this embodiment provides a needle bed and needle combination. The needle bed and needle combination includes a needle bed 1 provided with a plurality of needle grooves 11, a plurality of parallel sinkers 13 provided at a front end of the needle bed, knitting needles 51, 52 and jacks 65, 66 provided in the needle grooves. The jack 65 comprises stitch butts 651 and a connecting head 652. The jack 66 comprises stitch butts 661 and a connecting head 662. The needle bed and needle combinations are provided on each of the front and back sides of a frame 9 of a flat knitting machine through the needle bed 1. Two knitting needles 51, 52, are arranged on the left and right in the needle groove 11 between every two sinkers in a width direction of the needle groove, and are arranged at an angle with each other in their respective needle grooves in a length direction. The knitting needles 51, 52 are respectively connected to the jacks 65, 66, and the two knitting needles are separately driven by the corresponding jacks to make knitting actions including a knit stitch, a tuck stitch and a loop transfer stitch.

Figure 55:
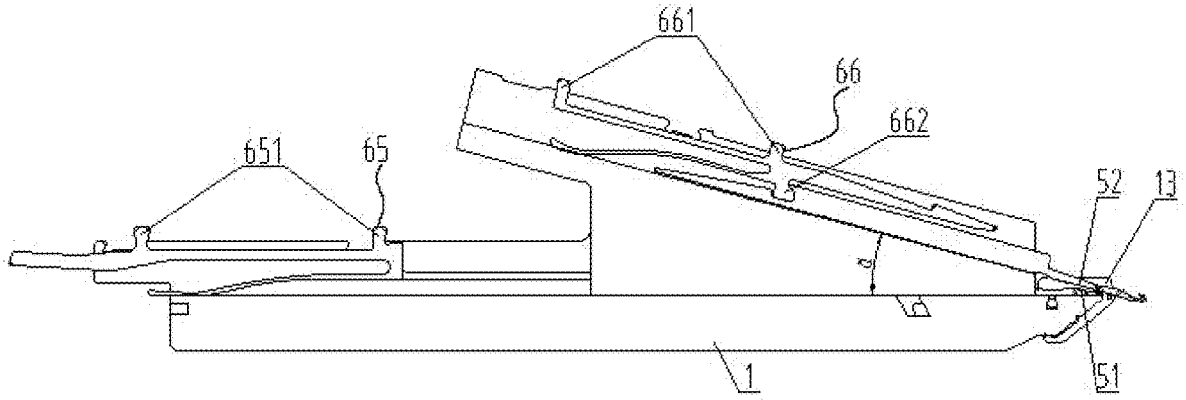
FIG. 55 is a schematic view showing that a knitting needle 52 is ejected while a knitting needle 51 is not ejected and is positioned in close proximity to a strip-shaped opening.
Figure 56:
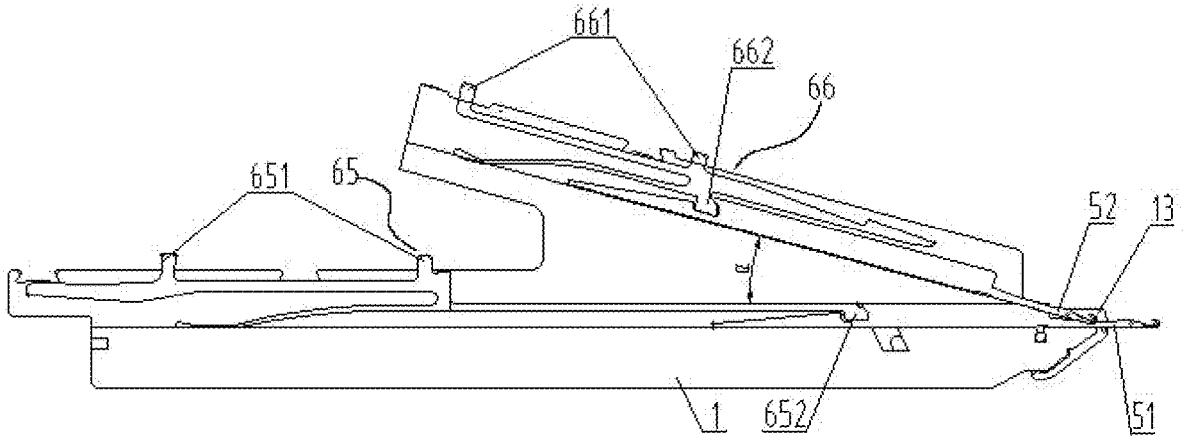
FIG. 56 is a schematic view showing that the knitting needle 51 is ejected while the knitting needle 52 is not ejected and is positioned in close proximity to the strip-shaped opening.

The two needle grooves corresponding to the two knitting needles are a needle groove 111 and a needle groove 112, which are formed through further divided by a separating piece 14 from needle groove 11 formed through division by two steel pieces 15. The needle groove 111 has a bottom surface that is substantially parallel with an upper end surface of the needle bed 1. Bottom surfaces of the needle groove 111 and the needle groove 112 are relatively inclined to form an angle $\alpha$, where $\alpha$ is generally not greater than 40°. Therefore, the bottom surfaces of the needle groove 111 and the needle groove 112 are different surfaces, such that the two knitting needles 51, 52 provided in the needle groove 111 and the needle groove 112 are at an angle $\alpha$ in a length direction. Front ends of the two knitting needles 51, 52 are positioned in close proximity to a strip-shaped opening in an initial state, as shown in FIGS. 55 and 56.

Overall, in the present disclosure, two knitting needles are arranged between every two sinkers with the same spacing, increasing the number of knitting needles without increasing the number of sinkers, and maximizing usage of the lateral space of the needle bed. In this way, the flat knitting machine with double needle beds can produce three-dimensional knitted fabric with a standard gauge. In addition, since the two knitting needles arranged on the left and right between every two adjacent sinkers are positioned in close proximity to the strip-shaped opening, so the two knitting needles which knit separately have the same knitting effect. Therefore, the flat knitting machine of the present disclosure has a simple on-machine process and is easy to operate.

What is claimed is:

1. A needle bed and needle combination for a flat knitting machine, provided on each of front and back sides of a frame of the flat knitting machine, and comprising:

a needle bed provided with a plurality of needle grooves formed by every two adjacent steel pieces, a plurality of parallel sinkers provided at a front end of the needle bed, knitting needles and stitch elements configured to drive movements of the knitting needles, wherein the knitting needles and the stitch elements are provided in the needle grooves, and a strip-shaped opening is formed by the sinkers and the front end of the needle bed for forming a knitted fabric;

wherein a needle groove of the plurality of needle grooves, formed by two adjacent steel pieces, is provided between every two adjacent sinkers of the plurality of parallel sinkers on the needle bed; and two knitting needles of the knitting needles are arranged on left and right in the needle groove between every two adjacent sinkers of the plurality of parallel sinkers without having a separating piece between the two knitting needles, and each knitting needle of the two knitting needles is configured to separately make a knit stitch, a tuck stitch, and a loop transfer stitch.

2. The needle bed and needle combination for the flat knitting machine according to claim 1, wherein the two knitting needles are arranged in parallel, and a front end of each of the two knitting needles is positioned in close proximity to the strip-shaped opening.

3. The needle bed and needle combination for the flat knitting machine according to claim 2, wherein the stitch elements comprise elastic stitch elements and jacks configured to be driven by a corresponding cam on a cam plate of the flat knitting machine and drive the movement of the knitting needles in the needle grooves; two elastic stitch elements of the elastic stitch elements are connected to the two knitting needles in the needle groove between every two adjacent sinkers, respectively; and a jack of the jacks is located above and engaged with the two elastic stitch elements.

4. The needle bed and needle combination for the flat knitting machine according to claim 3, further comprising needle selection units, wherein each of the needle section units is respectively provided between every two adjacent sinkers of the plurality of parallel sinkers, wherein a needle selection unit of the needle selection units is provided above the two elastic stitch elements of the elastic stitch elements, and is configured to operate on the two elastic stitch elements; and when being operated on, an operated elastic stitch element of the two elastic stitch elements is deformed elastically to disengage from the jack, to idle a corresponding knitting needle of the two knitting needles connected to the operated elastic stitch element.

5. The needle bed and needle combination for the flat knitting machine according to claim 4, wherein the needle selection unit of the needle selection units comprises:

a plate-shaped control element provided on a cam plate of the flat knitting machine configured to move with the cam plate, a first pressing piece provided with a first pressing portion and a first control portion, and a second pressing piece provided with a second pressing portion and a second control portion;

wherein the first pressing portion and the second pressing portion are located above the two elastic stitch elements, respectively; the first control portion and the second control portion are respectively located at different positions in a length direction of the needle groove between every two adjacent sinkers of the plurality of parallel sinkers; the plate-shaped control element is configured to operate on the first control portion or the second control portion to move the first pressing piece or the second pressing piece, and the first pressing portion or the second pressing portion is configured to press a corresponding elastic stitch element of the two elastic stitch elements, such that the elastic stitch element being pressed is deformed elastically to disengage from the jack, to idle the corresponding knitting needle of the two knitting needles connected to the elastic stitch element being pressed.

6. The needle bed and needle combination for the flat knitting machine according to claim 5, wherein a lower side of each of the elastic stitch elements is provided with a limiting protrusion, and a bottom of each of the needle grooves is provided with a limiting groove; and when the limiting protrusion of the pressed elastic stitch element falls into the limiting groove due to elastic deformation, the limiting groove limits front-back movement of the pressed elastic stitch element.

7. The needle bed and needle combination for the flat knitting machine according to claim 4, wherein a support rod is provided in each of the needle grooves, and the jack is supported by the support rod to be located above the two elastic stitch elements.

8. A needle bed and needle combination for a flat knitting machine, provided on each of front and back sides of a frame of the flat knitting machine, and comprising:

a needle bed provided with a plurality of needle grooves formed by every two adjacent steel pieces, a plurality of parallel sinkers provided at a front end of the needle bed, knitting needles and stitch elements configured to drive movements of the knitting needles, wherein the knitting needles and the stitch elements are provided in the needle grooves, and a strip-shaped opening is formed by the sinkers and the front end of the needle bed for forming a knitted fabric;

wherein the needle bed and needle combination further comprises needle selection units; a needle groove of the plurality of needle grooves is provided between every two adjacent sinkers of the plurality of parallel sinkers on the needle bed; two knitting needles of the knitting needles are arranged on left and right in parallel in the needle groove between every two adjacent sinkers of the plurality of parallel sinkers without having a separating piece between the two knitting needles, and each knitting needle of the two knitting needles is configured to separately make a knit stitch, a tuck stitch, and a loop transfer stitch; the stitch elements comprise elastic stitch elements and jacks configured to be driven by a corresponding cam on a cam plate of the flat knitting machine and drive the movement of the knitting needles in the needle grooves; two elastic stitch elements of the elastic stitch elements are connected to the two knitting needles in the needle groove between every two adjacent sinkers, respectively; and a jack of the jacks is located above and engaged with the two elastic stitch elements; a needle selection unit of the needle selection units provided between every two adjacent sinkers of the plurality of parallel sinkers is provided above the two elastic stitch elements, and is configured to operate on the two elastic stitch elements; and when being operated on, an operated elastic stitch element is deformed elastically to disengage from the jack, to idle a corresponding knitting needle of the two knitting needles connected to the operated elastic stitch element.

9. The needle bed and needle combination for the flat knitting machine according to claim 8, wherein a front end of each of the two knitting needles is positioned in close proximity to the strip-shaped opening.

10. The needle bed and needle combination for the flat knitting machine according to claim 9, wherein the needle selection unit of the needle selection units comprises:

a plate-shaped control element provided on a cam plate of the flat knitting machine configured to move with the cam plate, a first pressing piece provided with a first pressing portion and a first control portion, and a second pressing piece provided with a second pressing portion and a second control portion;

wherein the first pressing portion and the second pressing portion are located above the two elastic stitch elements, respectively; the first control portion and the second control portion are respectively located at different positions in a length direction of the needle groove; the plate-shaped control element is configured to operate on the first control portion or the second control portion to move the first pressing piece or the second pressing piece, and the first pressing portion or the second pressing portion is configured to press a respective elastic stitch element of the two elastic stitch elements, such that the pressed elastic stitch element is deformed elastically to disengage from the jack, to idle the corresponding knitting needle of the two knitting needles connected to the pressed elastic stitch element.

11. The needle bed and needle combination for the flat knitting machine according to claim 10, wherein a lower side of each of the elastic stitch elements is provided with a limiting protrusion, and a bottom of each of the needle grooves is provided with a limiting groove; and when the limiting protrusion of the pressed elastic stitch element falls into the limiting groove due to elastic deformation, the limiting groove limits front-back movement of the pressed elastic stitch element.

12. The needle bed and needle combination for the flat knitting machine according to claim 9, wherein a support rod is provided in each of the needle grooves, and each of the jacks is supported by a corresponding support rod of the support rods to be located above the two corresponding elastic stitch elements of the elastic stitch elements.

13. A needle selection mechanism of a flat knitting machine, comprising:

two elastic stitch elements and a jack configured to be driven by a corresponding cam on a cam plate of the flat knitting machine and drive two knitting needles of the flat knitting machine to move in a needle groove of the flat knitting machine, the two knitting needles are arranged on left and right in parallel in the needle groove without having a separating piece between the two knitting needles, and a needle selection unit;

wherein the two elastic stitch elements are connected to two knitting needles of the flat knitting machine, respectively; the jack is located above and engaged with the two elastic stitch elements; and wherein the needle selection unit is provided above the two elastic stitch elements, and is configured to operate on the two elastic stitch elements; and when being operated on, the operated elastic stitch element of the two elastic stitch elements is deformed elastically to disengage from the jack, to idle a corresponding knitting needle of the two knitting needles connected to the operated elastic stitch element.

14. The needle selection mechanism according to claim 13, wherein the needle selection unit comprises:

a plate-shaped control element provided on a cam plate of the flat knitting machine configured to move with the cam plate, a first pressing piece provided with a first pressing portion and a first control portion, and a second pressing piece provided with a second pressing portion and a second control portion;

wherein the first pressing portion and the second pressing portion are located above the two elastic stitch elements, respectively; the first control portion and the second control portion are respectively located at different positions in a length direction of the needle groove of the flat knitting machine; the plate-shaped control element is configured to operate on the first control portion or the second control portion to move the first pressing piece or the second pressing piece, and the first pressing portion or the second pressing portion is configured to press a respective elastic stitch element of the two elastic stitch elements, such that the pressed elastic stitch element is deformed elastically to disengage from the jack, to idle the corresponding knitting needle of the two knitting needles connected to the pressed elastic stitch element.

15. The needle selection mechanism according to claim 14, wherein the first pressing piece and the second pressing piece are configured to move up and down, and are arranged side by side in the needle groove; each of the first pressing piece and the second pressing piece comprises a main body and a protrusion; the protrusion of the first pressing piece and the protrusion of the second pressing piece are provided at upper side ends of corresponding main bodies respectively to form the first control portion of the first pressing piece and the second control portion of the second pressing piece; lower sides of the main bodies of the first pressing piece and the second pressing piece are provided with the first pressing portion and the second pressing portion, respectively; the plate-shaped control element includes two pressing plates provided on the cam plate of the flat knitting machine, and located above the protrusion of the first pressing piece and the protrusion of the second pressing piece, respectively; each of the two pressing plates is provided with two inclined surfaces; when moving with the cam plate, a corresponding pressing plate of the two pressing plates operates on the protrusion of a corresponding pressing piece of the first pressing piece and the second pressing piece through the inclined surfaces, such that the corresponding pressing piece is configured to move downward to press the respective elastic stitch element; and after the operation of the plate-shaped control element on the corresponding pressing piece is removed, a returning force of elastic deformation of the pressed elastic stitch element makes the corresponding pressing piece return to an original position.

16. The needle selection mechanism according to claim 15, wherein the first pressing piece and the second pressing piece have a same structure and a same shape in the main body and the protrusion, respectively; the first pressing piece and the second pressing piece are arranged side by side in the needle groove, with respective main bodies overlapped with each other, and are located above the two elastic stitch elements, respectively; the protrusion of the first pressing piece and the protrusion of the second pressing piece are located at an upper left end of the first pressing piece and an upper right end of the second pressing piece, respectively, and staggered from each other in a length direction of the needle groove; the main body is provided with two vertical guide surfaces at left and right sides and a vertical guide groove at a lower central position; the guide groove divides the first pressing portion or the second pressing portion at a lower side of the first pressing piece or the second pressing piece into two parts; the needle bed of the flat knitting machine is provided with guide steel wires at positions corresponding to the two guide surfaces and the guide groove, respectively; and the first pressing piece or the second pressing piece is configured to move up and down along the guide steel wires.

17. The needle selection mechanism according to claim 15, wherein the first pressing piece and the second pressing piece have a same structure and a same shape in the main body and the protrusion, respectively; the first pressing piece and the second pressing piece touch each other, are arranged side by side in the needle groove, and are located above the two elastic stitch elements, respectively; the protrusion of the first pressing piece and the protrusion of the second pressing piece are located at an upper left end of the first pressing piece and an upper right end of the second pressing piece, respectively, and staggered from each other in a length direction of the needle groove; both of the main body and the protrusion have a thickness adapted to a width of the needle groove; a lower side of the main body is provided with a recess structure to form a lower side edge that is not greater than half the width of the needle groove; the main body is provided with a guide surface and a sliding surface at left and right sides, respectively; the needle bed is provided with guide steel wires corresponding to the guide surface; the first pressing piece is configured to move up and down along the guide steel wires corresponding to the guide surface of the first pressing piece and the sliding surface of the second pressing piece; and the second pressing piece is configured to move up and down along the guide steel wires corresponding to the guide surface of the second pressing piece and the sliding surface of the first pressing piece.

18. The needle selection mechanism according to claim 14, wherein the first pressing piece and the second pressing piece are rotationally and coaxially provided in the needle groove; each of the first pressing piece and the second pressing piece comprises a main body and a protrusion; the protrusion of the first pressing piece and the protrusion of the second pressing piece are located at staggered positions with different distances from a rotation center respectively to form a first control portion of the first pressing piece and a second control portion of the second pressing piece; lower sides of the main bodies of the first pressing piece and the second pressing piece are provided with the first pressing portion and the second pressing portion, respectively; the plate-shaped control element is provided on the cam plate of the flat knitting machine; when plate-shaped the control element operates on the first control portion or the second control portion, the first pressing piece or the second pressing piece is rotated downward to press the respective elastic stitch element; and after operation of the plate-shaped control element on the first control portion of the first pressing piece or the second control portion of the second pressing piece is removed, a returning force of elastic deformation of the pressed elastic stitch element makes a corresponding pressing piece of the first pressing piece and the second pressing piece return to an original position.

19. The needle selection mechanism according to claim 18, wherein the first pressing piece and the second pressing piece have a same structure and a same shape in the main body and the protrusion, respectively; the protrusion of the first pressing piece and the protrusion of the second pressing piece are located on an upper side of the main body of the first pressing piece and an upper side of the main body of the second pressing piece, respectively, and are staggered from each other; the main body of the first pressing piece and the main body of the second pressing piece are respectively provided with rotating holes at identical positions on a same side; the needle bed is provided with a rotating steel wire corresponding to the rotating holes, and provided with a limiting steel wire located above upper sides of the first pressing piece and the second pressing piece; the first pressing piece and the second pressing piece are provided in the needle groove and rotatable by the rotating steel wire passing through the rotating holes; the limiting steel wire limits movement of the first pressing piece and the second pressing piece caused by a returning force; the plate-shaped control elements are two pressing plates provided on the cam plate of the flat knitting machine at positions corresponding to the protrusion of the first pressing piece and the protrusion of the second pressing piece, respectively; each of the two pressing plates is provided with two inclined surfaces; and when moving with the cam plate, the corresponding pressing plate of the two pressing plates presses the protrusion of the corresponding pressing piece of the first pressing piece or the second pressing piece downward through the inclined surface, such that the first pressing piece or the second pressing piece is rotated downward around the rotating steel wire.

20. The needle selection mechanism according to claim 18, wherein the needle selection unit further comprises a push piece; the push piece is provided with a needle butt and a push pin at upper and lower sides of the push piece, respectively; the first pressing piece and the second pressing piece have a same structure and a same shape in the main body; the first pressing piece comprises a first protrusion and the second pressing piece comprises a second protrusion; the first protrusion is provided with a climbing surface, a descending surface, and an upper end surface connecting upper ends of the climbing surface and the descending surface; the second protrusion is provided with at least a climbing surface and an upper end surface connected to an upper end of the climbing surface; the first protrusion and the second protrusion are provided on an upper side of the main body of the first pressing piece and an upper side of the main body of the second pressing piece, respectively; furthermore, a distance between the first protrusion and the rotation center is smaller than a distance between the second protrusion and the rotation center; the main body of the first pressing piece and the main body of the second pressing piece are respectively provided with rotating holes at identical positions on a same side; the needle bed is provided with a rotating steel wire at a position corresponding to the rotating holes, and provided with a stopper and a limiting steel wire at positions corresponding to the upper and lower sides of the push piece, respectively; the first pressing piece and the second pressing piece are provided in the needle groove and rotatable by the rotating steel wire passing through the rotating holes; the push piece is located above the first pressing piece and the second pressing piece, and is configured to slide between the stopper and the limiting steel wire; the plate-shaped control element is a push plate provided on the cam plate of the flat knitting machine, and is configured to move in a length direction of the needle groove; the push plate is provided with a guide groove adapted to the needle butt; when the push plate moves with the cam plate, the needle butt of the push piece is inserted into the push plate through the guide groove; and through the movement of the plate-shaped control element in the length direction of the needle groove, the push pin operates the climbing surface of the first protrusion or the second protrusion to rotate the corresponding pressing piece downward.

21. The needle selection mechanism according to claim 13, wherein a lower side of each of the two elastic stitch elements is provided with a limiting protrusion, and a bottom of the needle groove of the knitting machine is provided with a limiting groove; and when the limiting protrusion of the pressed elastic stitch element falls into the limiting groove due to elastic deformation, the limiting groove limits front-back movement of the pressed elastic stitch element.

22. The needle selection mechanism according to claim 13, wherein a support rod is provided in each of the needle grooves of the flat knitting machine, and each of the jacks is supported by a corresponding support rod of the support rods to be located above two corresponding elastic stitch elements of the elastic stitch elements.

* * * * *